US007134673B2

(12) United States Patent
Ferraro et al.

(10) Patent No.: US 7,134,673 B2
(45) Date of Patent: Nov. 14, 2006

(54) MOVING CART ASSEMBLIES

(76) Inventors: Frank A. Ferraro, 104 Garwood Rd., Trumbull, CT (US) 06611; Robert J Murphy, 244 Ledge Dr., Torrington, CT (US) 06790

( * ) Notice: Subject to any disclaimer, the term of this patent is extended or adjusted under 35 U.S.C. 154(b) by 39 days.

(21) Appl. No.: 10/796,601

(22) Filed: Mar. 9, 2004

(65) Prior Publication Data

Related U.S. Application Data

(63) Continuation of application No. 09/878,872, filed on Jun. 11, 2001, now abandoned.

(51) Int. Cl.
*B62B 1/12* (2006.01)

(52) U.S. Cl. ..... 280/33.991; 280/33.992; 280/33.993; 280/33.994; 280/33.998; 280/47.18; 280/79.2; 280/79.3

(58) Field of Classification Search ..... 280/33.991–33.998, 79.3, 79.2, 47.26–35, 280/47.18
See application file for complete search history.

(56) References Cited

U.S. PATENT DOCUMENTS

| | | | | |
|---|---|---|---|---|
| 1,800,963 | A | 4/1931 | Schiff | |
| 3,343,899 | A | 9/1967 | Cousins et al. | |
| 3,908,831 | A * | 9/1975 | Brendgord | 211/88.01 |
| 4,113,329 | A | 9/1978 | Thurman | |
| 4,202,586 | A | 5/1980 | Oplinger | |
| 4,353,470 | A | 10/1982 | Polhemus et al. | |
| 4,436,355 | A | 3/1984 | Fortune | |
| 4,497,524 | A | 2/1985 | Levings, Jr. et al. | |
| 4,592,601 | A * | 6/1986 | Hlinsky et al. | 312/111 |
| 4,681,378 | A | 7/1987 | Hellman, III | |
| 4,699,270 | A | 10/1987 | Bohm | |
| 5,118,124 | A * | 6/1992 | Storay et al. | 280/47.21 |
| 5,137,340 | A | 8/1992 | Cugley et al. | |
| 5,147,120 | A | 9/1992 | Ray | |
| 5,445,397 | A * | 8/1995 | Evans | 280/47.18 |
| 5,480,191 | A * | 1/1996 | Litin et al. | 280/831 |
| 5,666,713 | A | 9/1997 | Kubota | |
| 5,704,699 | A | 1/1998 | Pagelow et al. | |
| 5,823,550 | A * | 10/1998 | Bennett et al. | 280/47.26 |
| 5,888,114 | A * | 3/1999 | Slocum et al. | 446/128 |
| 5,913,580 | A | 6/1999 | Liu | |
| 5,921,047 | A * | 7/1999 | Walker | 52/585.1 |
| 5,921,646 | A * | 7/1999 | Hwang | 312/263 |
| 5,975,660 | A | 11/1999 | Tisbo et al. | |
| 5,992,953 | A * | 11/1999 | Rabinovitz | 312/111 |
| 6,039,417 | A | 3/2000 | Snoke et al. | |

(Continued)

FOREIGN PATENT DOCUMENTS

| | | |
|---|---|---|
| EP | 0300134 | 1/1989 |

(Continued)

*Primary Examiner*—J. Allen Shriver
*Assistant Examiner*—Cynthia F. Collado
(74) *Attorney, Agent, or Firm*—Daniel P. Burke & Assocs., PLLC

(57) ABSTRACT

The various aspects of the present invention are directed to moving carts and moving cart assemblies. One embodiment comprises a moving cart assembly with a plurality of interlocking, vertically stackable, storage modules. The modules of this embodiment comprise a frame, preferably having at least four sides, e.g., a top, a back, a right side and a left side. Each module also comprises something to enclose the interior space, such as a pair of doors or a drawer which is selectively slidable into the frame. The needs of a particular office can be readily accommodated by using greater or fewer numbers of drawer modules and/or cabinet-type modules.

83 Claims, 22 Drawing Sheets

U.S. PATENT DOCUMENTS

| | | | | |
|---|---|---|---|---|
| 6,193,340 | B1 | 2/2001 | Schenker et al. | |
| 6,247,769 | B1 | 6/2001 | Spitzer et al. | |
| 6,431,580 | B1 * | 8/2002 | Kady | 280/655 |
| 6,488,346 | B1 | 12/2002 | Chen | |
| 6,557,955 | B1 * | 5/2003 | Saravis | 312/111 |
| 2002/0093272 | A1 | 7/2002 | Saravis | |
| 2002/0125799 | A1 | 9/2002 | Landsberger et al. | |
| 2002/0171332 | A1 | 11/2002 | Skov et al. | |

FOREIGN PATENT DOCUMENTS

| | | |
|---|---|---|
| GB | 2226236 | 6/1990 |

* cited by examiner

MOVING CART ASSEMBLIES

RELATED APPLICATION DATA

This application is a continuation of U.S. patent application Ser. No. 09/878,872 filed on Jun. 11, 2001, now abandoned.

The present invention is directed to moving carts and moving cart assemblies particularly suited for moving office equipment and files.

BACKGROUND

Businesses change locations for a variety of reasons including expansions, contractions, or simply for more attractive office space. Many modern offices comprise computer equipment including a computer monitor, a CPU, a keyboard, a printer, and possibly other computer peripherals. Additionally, offices typically comprise many files which can be of different sizes, for example, folders for holding letter size files (8½×11 inches) and folders for holding legal size paper (8½×14 inches), as well as books, stationary and other business and personal items.

Presently, when a business comprising many offices is moving, a moving company will typically put the computer equipment and files into boxes or crates, place the boxes on dollies, and then transport the boxes onto moving trucks for transporting to the new location. The boxes need to be taped, labeled and still pose a significant risk of confusion when numerous boxes are being moved. The business disruption caused by such a move can extend over several days in light of the time for boxing, transportation and delivering the equipment and files to each employees' new office or work area. Typically, employees do not have access to their files while a move is in progress.

It would, therefore, be desirable to provide equipment which facilitates a more efficient and cost-effective move, while minimizing the risk of confusion, business disruption and the risk of mingled files.

SUMMARY OF THE INVENTION

The various aspects of the present invention are directed to moving carts and moving cart assemblies which are durable, reusable and yet relatively inexpensive. The cart assemblies of the present invention are sufficiently rigid to provide adequate protection to the items being moved and are designed to save time during a move and to provide wide flexibility in the containers of the items being moved.

One preferred embodiment of the present invention comprises a moving cart assembly with a plurality of interlocking, vertically stackable, storage modules. The modules of this embodiment comprise a frame, preferably having at least four sides, e.g., a top, a back, a right side and a left side. Each of these sides is more preferably "closed", i.e., preferably a total enclosure, in order to protect items from dust, water, etc., and to prevent items from falling out or being removed by non-authorized persons. Each module further comprises something to enclose the interior space, such as a pair of doors or a drawer which is selectively slidable into the frame. When one of these modules is stacked onto another module, the top of one frame serves as the floor of the adjacent higher module. In this modular embodiment of the present invention, the moving container needs of a particular office can be readily accommodated by using greater or fewer numbers of drawer modules and/or cabinet-type modules.

The drawer modules are advantageously dimensioned and provided with interior rails in order to accommodate hanging files which can be of one or a plurality of sizes. For example, one or more drawers may be provided with rails for hanging files which are dimensioned to receive legal size files and/or letter hanging files. The use of modules provides wide flexibility in accommodating the contents of a particular office.

Another aspect of the preferred embodiment of the present invention is that these embodiments are formed of durable thermoplastic materials and/or structural foam resins in order to keep the costs of manufacturing low, however, they can also be made of wood or metal.

The preferred moving assemblies of the present invention can be delivered to the offices being moved and then loaded by the moving employees themselves, rather than personnel for the moving company. These preferred moving assemblies are designed to permit continuous access to the employees' files even after the files and items have been loaded. Typically, the employees' computer equipment would be the last items to be loaded into a moving assembly and would be disconnected and loaded onto the assembly just prior to moving. The moving assemblies of the present invention would, therefore, significantly reduce the amount of time that personnel of the moving company would be at the business which is being moved and would also reduce the time that the employees of the business being moved would not have access to their files. The moving assemblies would also minimize the risk of lost files or the inadvertent delivery of one employee's files to another employee's new office.

DETAILED DESCRIPTION

Figures 1, 2, 3:
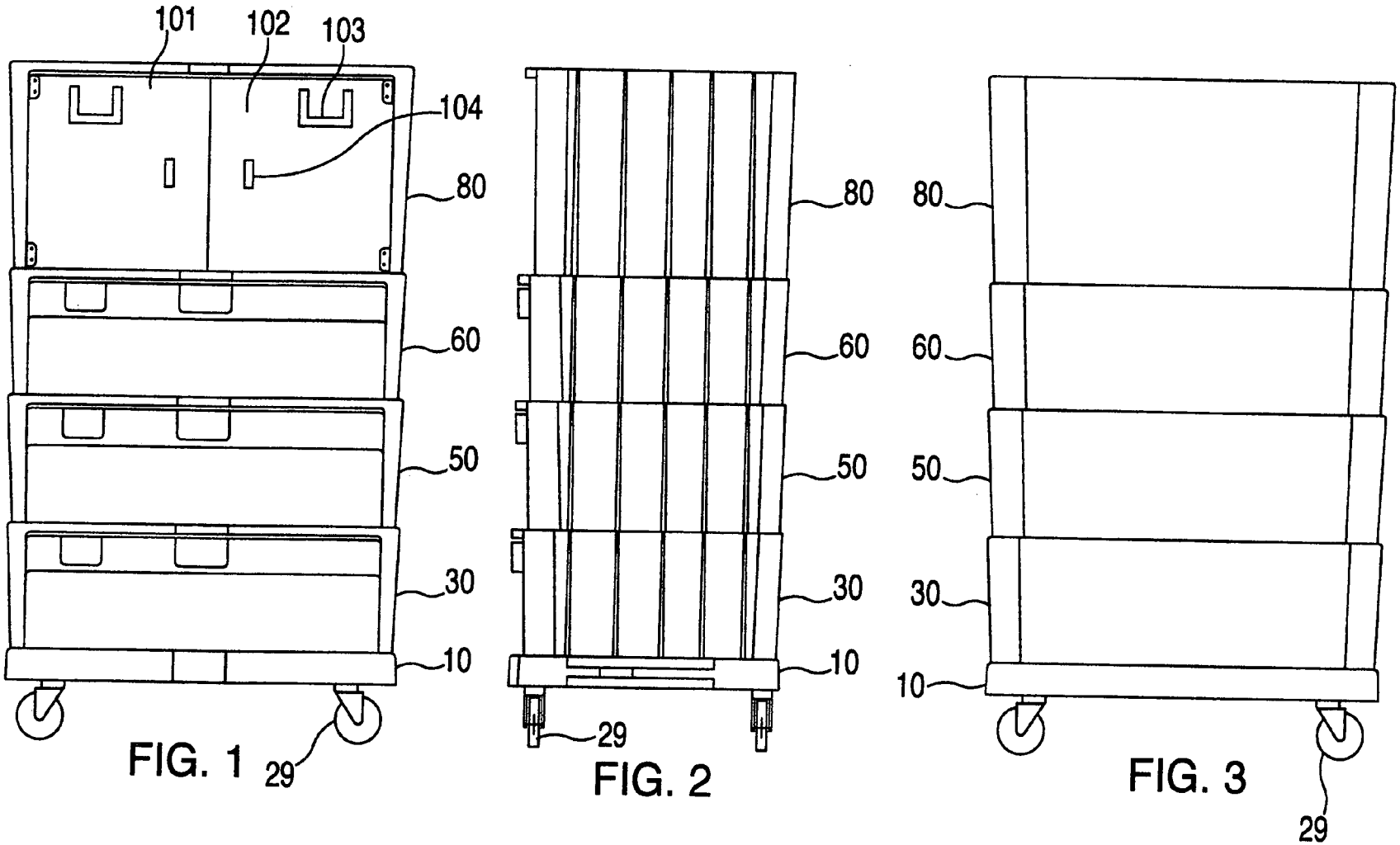
FIG. 1 is front view of one embodiment of the present invention.
FIG. 2 is a side view of the embodiment shown in FIG. 1.
FIG. 3 is a rear view of the embodiment shown in FIG. 1.
Figure 4:
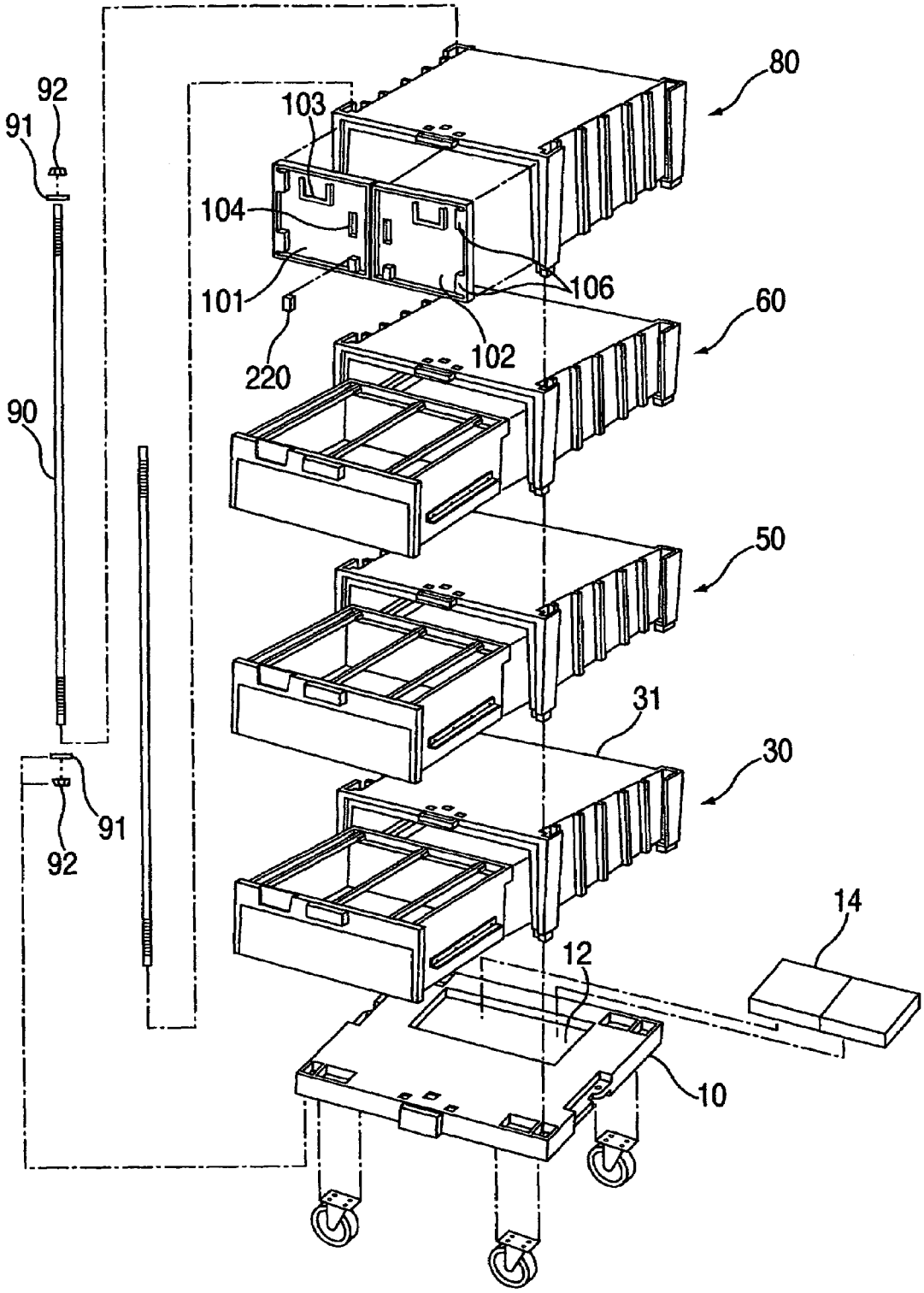
FIG. 4 is an exploded view of the embodiment shown in FIG. 1.
Figure 32:
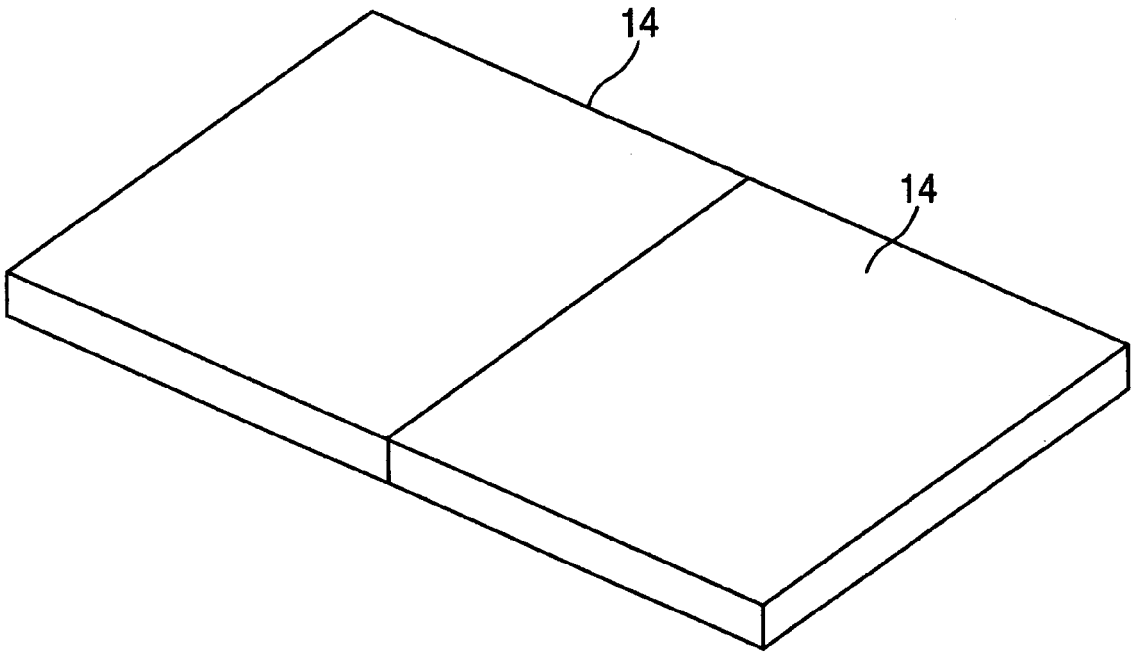
FIG. 32 illustrates a perspective view of weights.

Various aspects of the present invention are directed to moving carts and moving cart assemblies. One preferred embodiment which is illustrated in FIGS. 1–4 comprises a base 10 mounted on sturdy casters 29 and having at least one recess 12 for one or more counter-weights 14 to provide balance when one or more loaded drawers are open. Counter weights 14 are shown in FIG. 4 and FIG. 32. Referring again to FIGS. 1–4, this illustrated embodiment comprises a lower drawer module 30, a middle drawer module 50, an upper drawer module 60, and a cabinet module 80. FIGS. 1, 2 and 3 are front, side and rear views, respectively, of this embodiment of the present invention.

As best shown in FIG. 4 which is an exploded view, in this illustrated embodiment the three drawer modules and the upper cabinet module are arranged in a vertically stacked, interconnected arrangement. Each module in this illustrated embodiment comprises a frame having two sides, a top portion and a closed back portion. While this preferred illustrated embodiment comprises sides, a top, and a back which are continuous, unitary pieces and which are closed in order to inhibit the ingress of dirt, dust, water, and pests to the items being moved as well as preventing unauthorized removal of items, is also within the scope of an alternative embodiment as the present invention to provide a frame which leaves portions open. Open portions would be less desirable since they would not provide the same degree of protection as the continuous, closed illustrated surfaces. From the exploded view, it will be appreciated that the top portion of drawer module 60 in this illustrated embodiment serves as a bottom surface for cabinet module 80. While it would be less desirable to do so, it is also possible to form a frame with fewer surfaces, including frames without a top surface. Other provisions would have to be made for supporting the contents of an adjacent, upper module.

Figure 5:
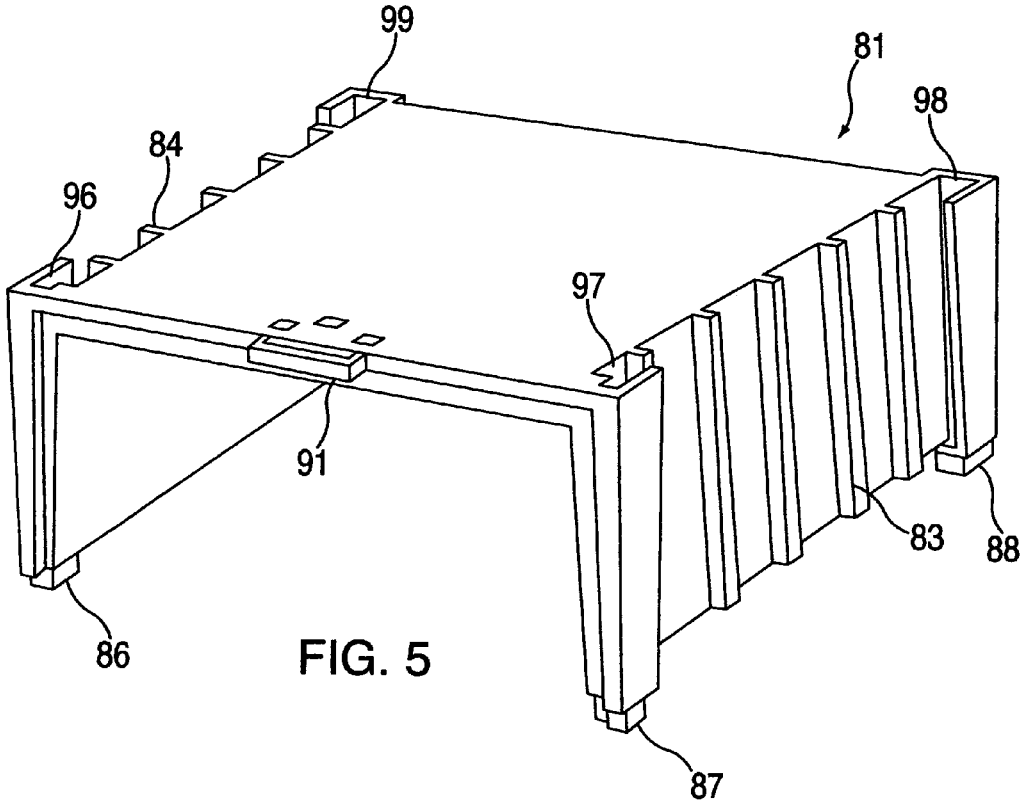
FIGS. 5 and 6 illustrate top perspective and bottom perspective views, respectively, of a cabinet frame shown in FIG. 4.
Figure 6:
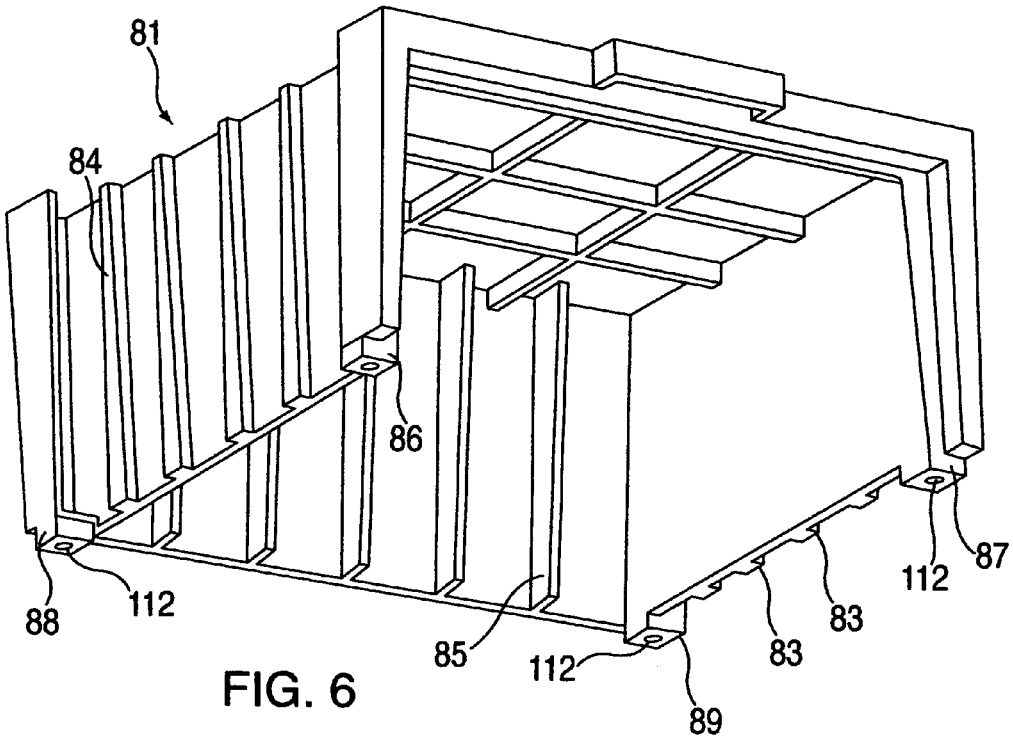
Figure 21:
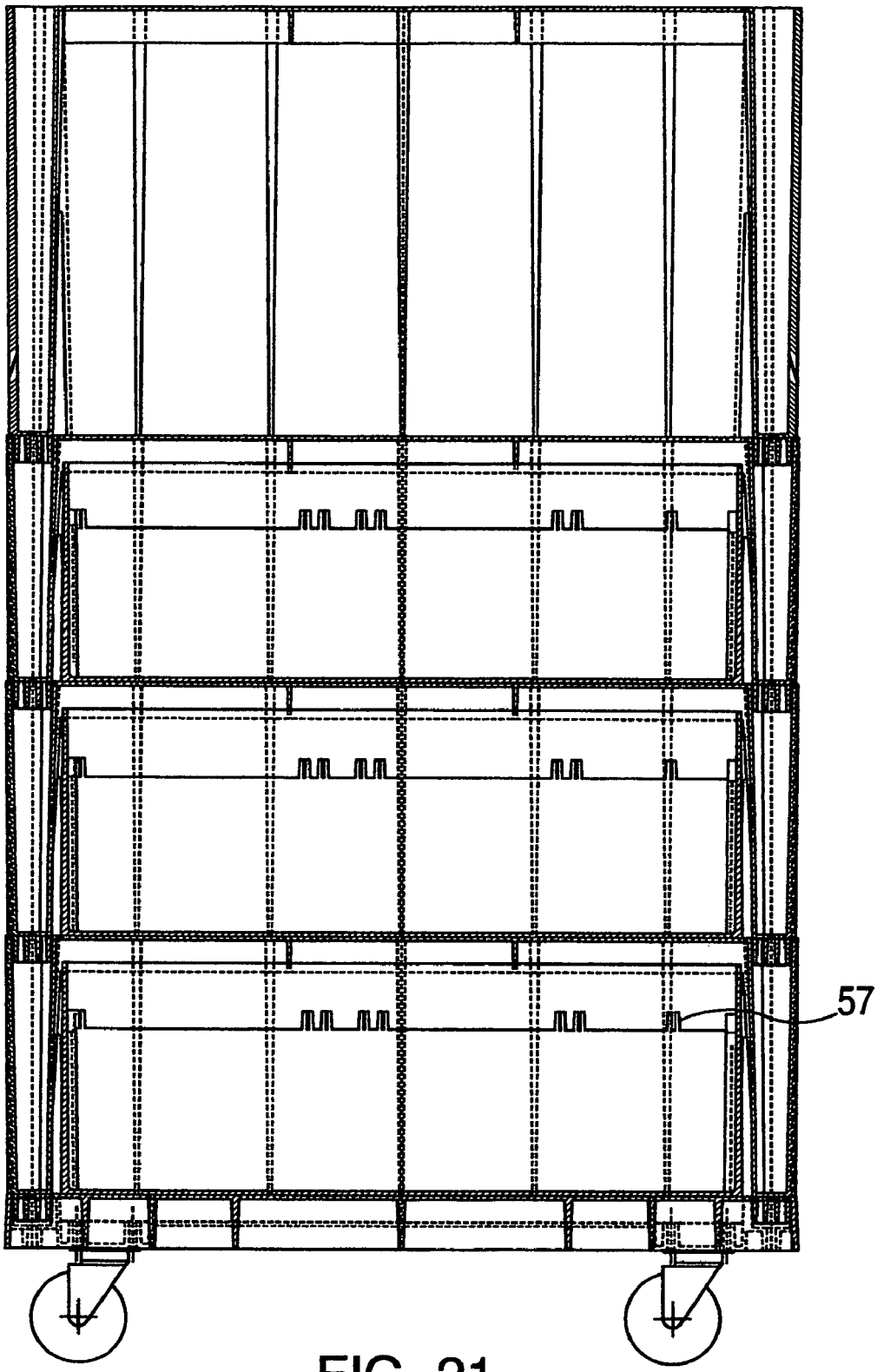
FIG. 21 is a cross-sectional view through side support ribs.

FIGS. 5 and 6 are top and bottom perspective views of a cabinet frame 81. In these illustrated embodiments, the entire frame 81 is integrally molded of a sturdy moldable material. Each frame is preferably integrally molded using a thermoplastic material such as high density polyethylene structural foam or polypropylene structural foam. In order to enhance the load carrying capacity of the cart and provide greater strength to each module, a plurality of substantially vertical ribs are most preferably integrally formed with the sides and rear surface of each frame. As shown in the illustrated embodiment, frame 81 comprises five support ribs 83 on the right side of the frame, five support ribs 84 on the left exterior surface of the frame and five support ribs 85 located on the interior surface of the rear wall of the cabinet frame 81. These substantially vertical support ribs can be located on the exterior surface, the interior surface and/or both on the interior and exterior of the frame as in the illustrated embodiment. The illustrated frames are advantageously provided with a plurality of vertically aligned ribs, as best illustrated in FIG. 2. These ribs add structural integrity to each frame and, due to their vertical alignment, provide added vertical support to the upper modules. The ribs on the illustrated side walls are supported by ribs on the lower, adjacent frame. Additionally, the side walls themselves are supported by the ribs of the lower, adjacent frame. The interior ribs on the illustrated rear frame wall rest on the top edge of the rear wall of the lower adjacent frame. As illustrated in FIG. 21, both the support ribs and the vertical walls (sides and back) of the bottom frame rest on the top surface of base 12 along with the side and back walls of the frame. From the drawings, particularly FIGS. 2 and 23, it will be appreciated that the vertical alignment of the support ribs on adjacent frames provides additional vertical support for upper frames and to the side walls.

Figure 7:
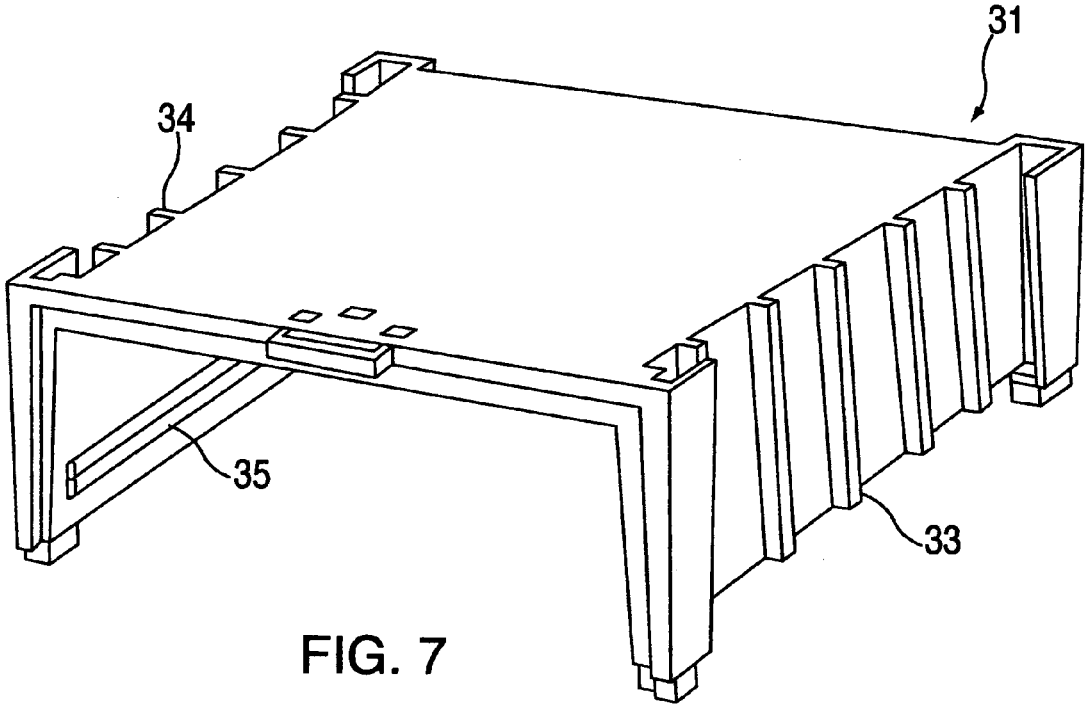
FIGS. 7 and 8 illustrate a top perspective and bottom perspective views, respectively, of a drawer frame shown in FIG. 4.
Figure 8:
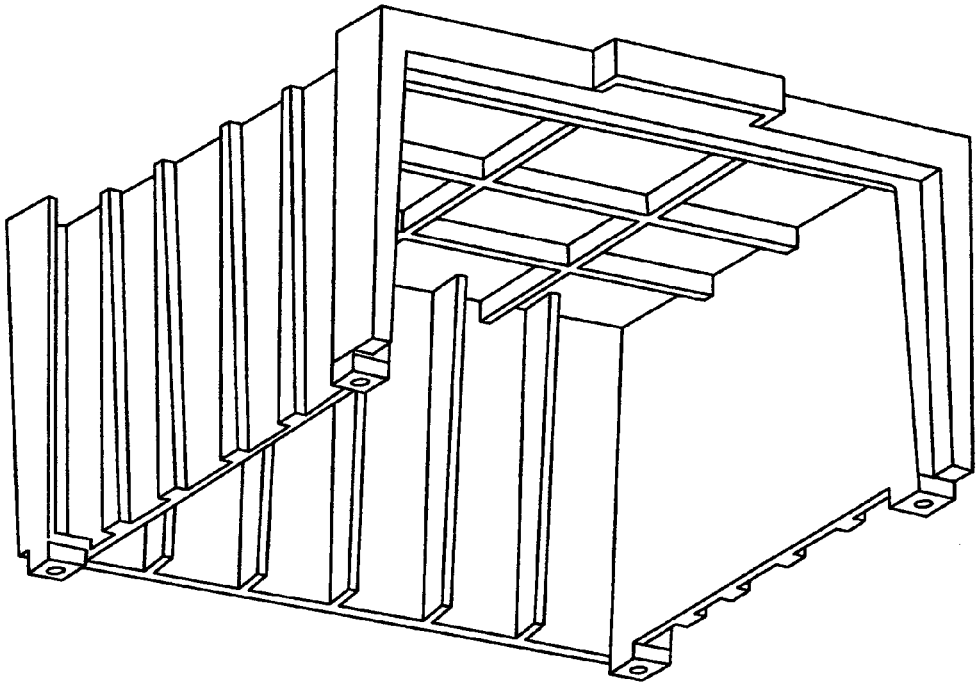

FIGS. 7 and 8 illustrate a drawer frame 31 which is similar to the cabinet frame. In these illustrated embodiments, the cabinet frame has an inside height of about 15 to 30 inches, preferably about 20 to 23 inches, while the drawer frame 31 has an inside height of about 9 to 15 inches, preferably about 10 to 12 inches.

Each frame also advantageously comprises protrusions which are shaped to be received in corresponding receptacles of the adjacent module. With reference to FIGS. 5 and 6, cabinet frame 81 comprises forward protrusions 86, 87 and rear protrusions 88, 89. Located directly above these protrusions are corresponding receptacles 96, 97, 98 and 99, respectively. The protrusions of an adjacent frame are simply inserted into the receptacles of a lower frame. In this manner, the modules are interconnected. In order to more securely connect a plurality of modules. Through holes 112 are provided in each of the protrusions in order to receive a tie-rod 90 or other connecting member which can be advantageously and quickly secured with washers and nuts. It is also within the scope of the present invention to use-other elements or structures to lock the components together, for example, snap assemblies, pins, screws, or tongue and grooved slide assemblies.

In order to facilitate the positioning of protrusions into a corresponding receptacle, the protrusions are advantageously slightly tapered. While the illustrated protrusions are geometric in shape, in this embodiment rectangular, it is also within the scope of the present invention to provide protrusions having other shapes. For example, the protrusions in corresponding receptacles can be round, square, rectangular, oval, etc. It is also within the scope of the present invention to provide forward protrusions which are not identical with the rear protrusions. One advantage of providing the forward protrusions with a different shape than the rear protrusions is to ensure that the modules are stacked facing the same direction.

In the embodiment illustrated in FIGS. 1–4, the top module comprises cabinet doors 101, 102. Each cabinet door is provided with an identification card slot 103 and integrally molded slots 104 which serve as handles for opening these doors. Barrel slide locks 220 also shown in FIG. 24, prevent the doors from opening during moving. In order to prevent damage to the doors and/or hinges during transporting, the hinges 106 of this embodiment are advantageously located inside the cabinet doors. As noted above, the top surface of adjacent, lower frame 60 serves as the floor for the cabinet space provided by upper module 80.

Figure 9:
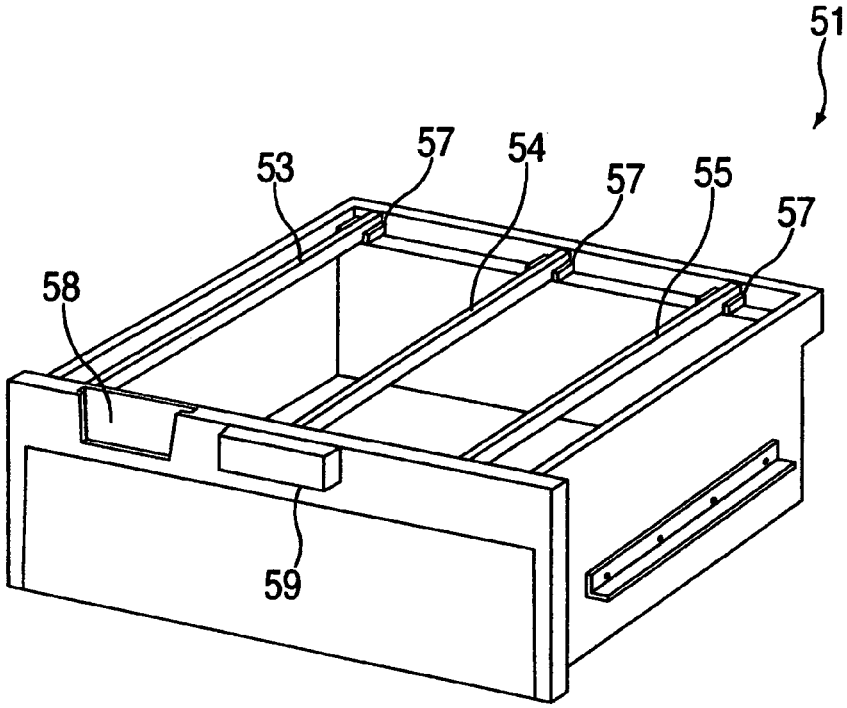
FIG. 9 is a perspective view of a drawer illustrated in FIG. 4.
Figure 22:
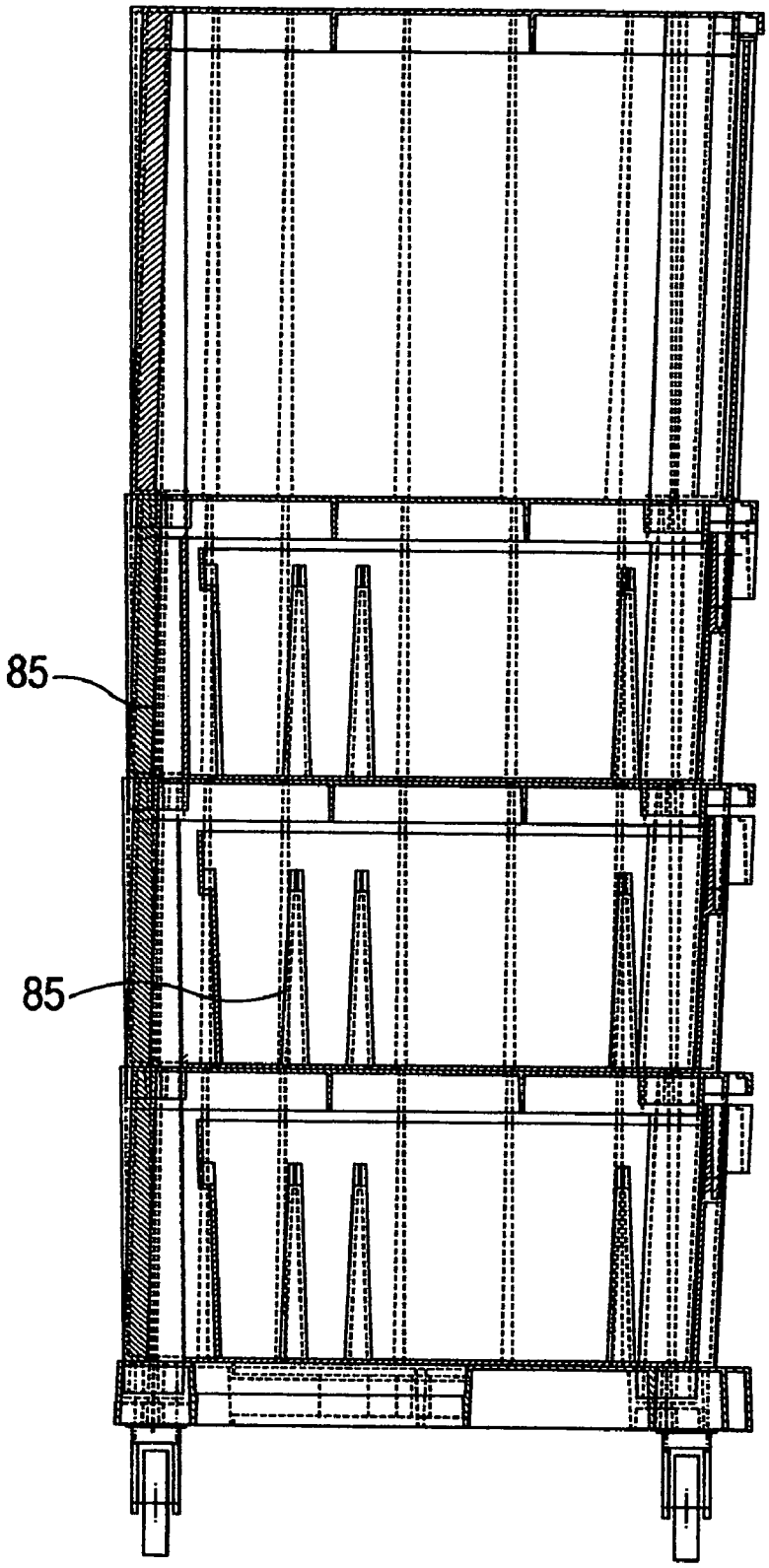
FIG. 22 is a cross-sectional view passing vertically through the center of a cart.

In this illustrated embodiment, the remaining three modules comprise sliding drawers. FIGS. 7 and 8 are perspective views of a drawer frame 31 while FIG. 9 is a perspective view of a drawer 51 which is designed to slide in and out of a drawer frame on drawer slides. FIG. 7 shows one drawer slide 35 on the interior side wall of drawer frame 31 while FIG. 9 illustrates a corresponding slide on an exterior side wall of drawer 51. From the present description, those skilled in the art will appreciate that various types of slides can be used without departing from the scope of the present invention. The interior of the drawer shown in FIG. 9 is advantageously provided with removable rails, such as rails 53, 54 and 55. The rails are advantageously mounted on slidable rail supports 57 which enable the spacing of the rails to be customized. Alternatively and/or in addition, the drawers can be provided with fixed rail supports which are spaced at different distances in order to allow ready storage of hanging files of different sizes. Alternatively, the position of the rails can be advantageously adjustable to slot locations at predetermined positions to accommodate different sizes of files, e.g., legal and letter size files. The embodiments shown in FIGS. 20–22 comprise drawers with internally-molded rail supports 57' in these embodiments, the rail supports are located on the inside of the drawers to provide either front to back support for the rails or side to side support for the rails. Each drawer face is also advantageously provided with an identification card slot 58 and an integrally molded handle 59.

A sliding barrel lock is advantageously mounted on the front of each door and drawer. When the doors and/or drawers are closed, the barrel is advantageously slid into a locked position in order to prevent the drawers and/or doors from opening during transit.

Figure 10:
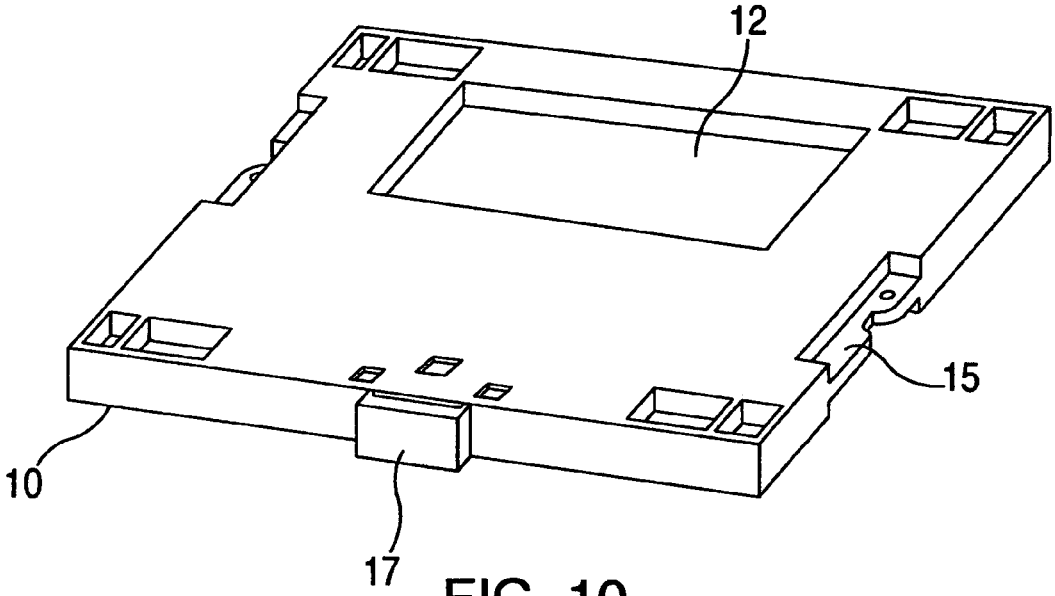
FIGS. 10 and 11 are top and bottom perspective views of the base shown in FIG. 4, respectively.
Figure 11:
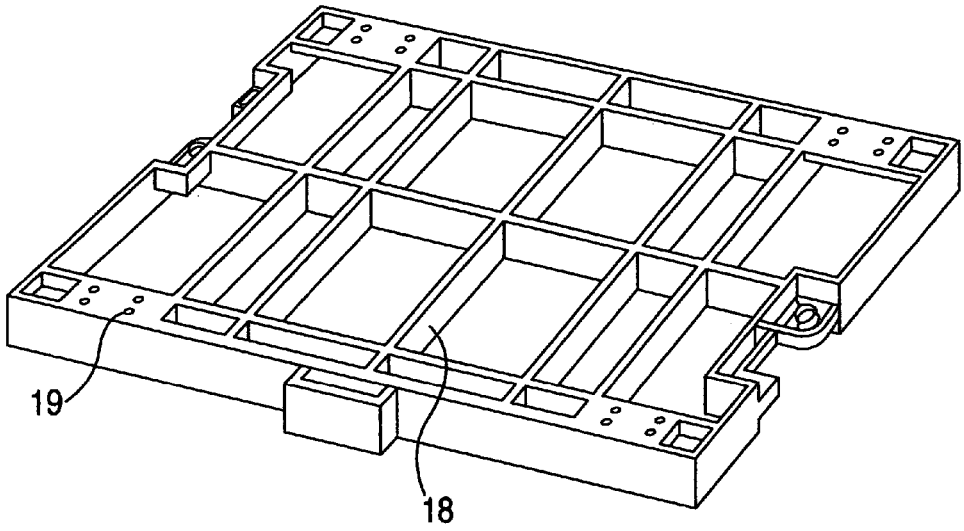
Figure 12:
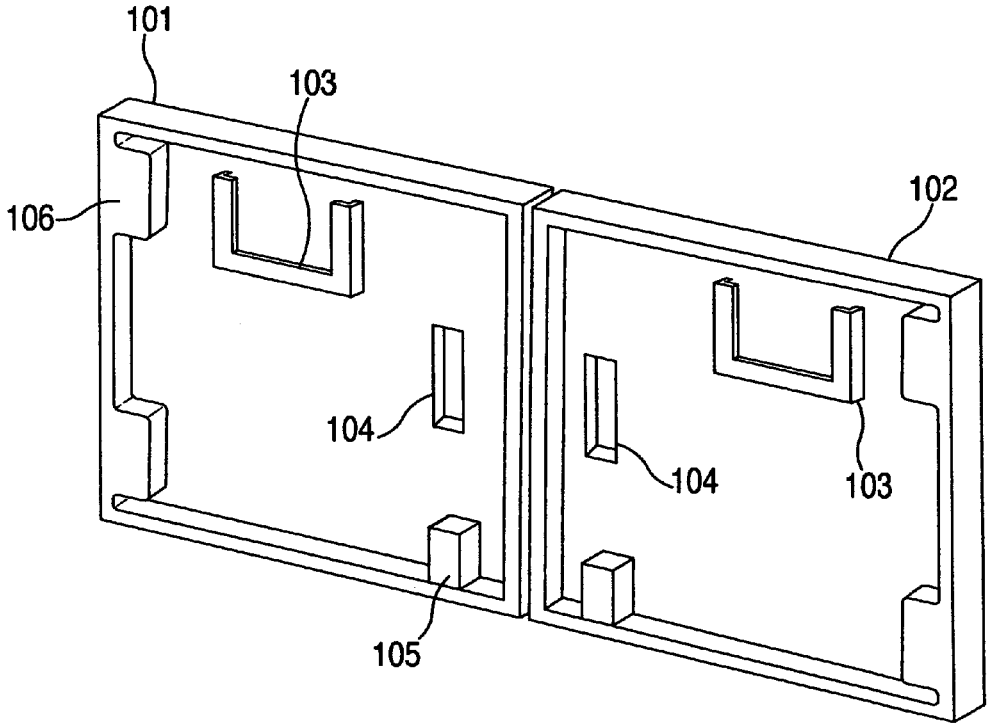
FIG. 12 is a perspective view of the cabinet doors shown in FIG. 4.
Figure 26:
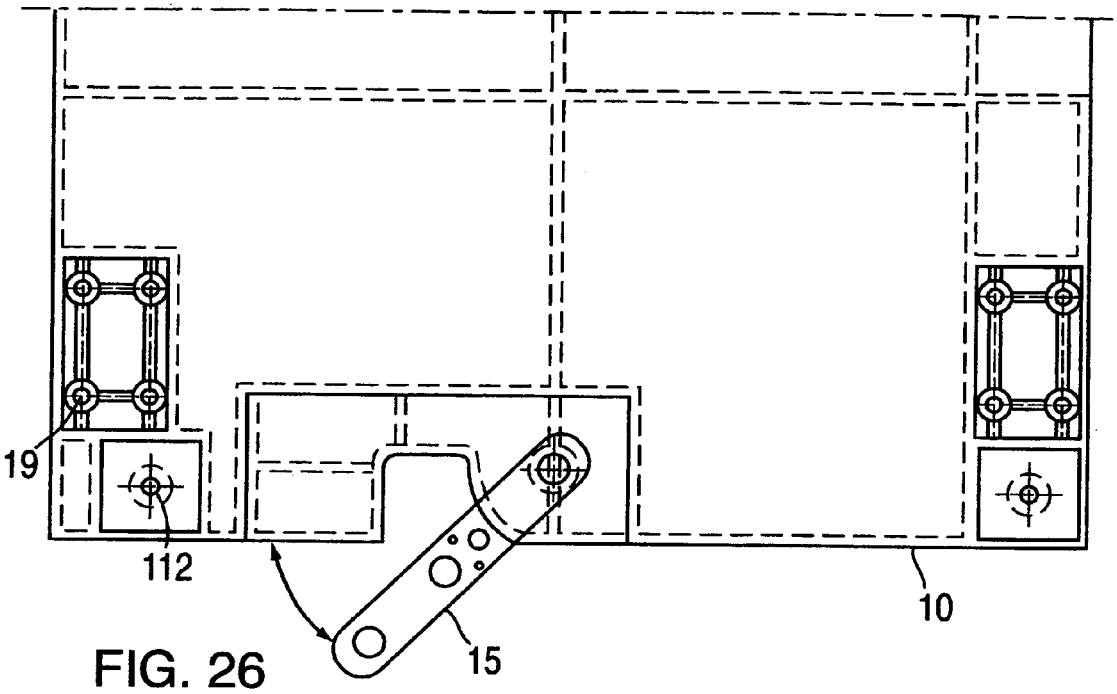
FIG. 26 is a top view of a portion of a base of one embodiment of the present invention.

FIGS. 10 and 11 are top and bottom perspective views of one preferred base of the present invention. The base 10 is advantageously provided with a recess 12 designed to accommodate weights 14, for example, plates of steel having desired dimensions, e.g., 1½"×10"×12", which serve as counterweights and add stability to the cart when loaded drawers are opened. Additionally, in this illustrated embodiment, base 10 is provided with two retractable hitches 15 which do not protrude when the hitch is not in use but which can be pivoted outwardly in order to allow interconnection of two hitches of adjacent carts with, for example, a pin-type connector. FIG. 26 illustrates a portion of a base and shows the retractable movement of hitch 15 which is provided with through holes in order to receive a pin for interconnection with a hitch of another cart. In order to prevent the hitches from abutting and in order to provide vertical overlapping, the hitches on the right side of a base are preferably spaced slightly vertically offset from the hitches on the left side. In this manner, when the hitches are pivoted to the outer, connecting position, one hitch will be readily connectable with the other hitch. With reference again to FIGS. 10 and 11, the base is also advantageously provided with an integrally molded handle 17 which also serves as a lock retainer as described in further detail below. As shown in the bottom view of FIG. 11, the base is preferably provided with structural support ribs 18 in order to provide additional structural integrity to the base and holes 19 positioned approximate each corner in order to facilitate attachment of casters 29 shown in FIG. 1.

The casters used on the cart are durable and sufficiently strong in order to hold the weight of the files and other equipment. For example, preferred casters should each have a load bearing capacity of about 75–300 lbs. each and, more preferably, at least about 150 lbs. each.

Figure 15:
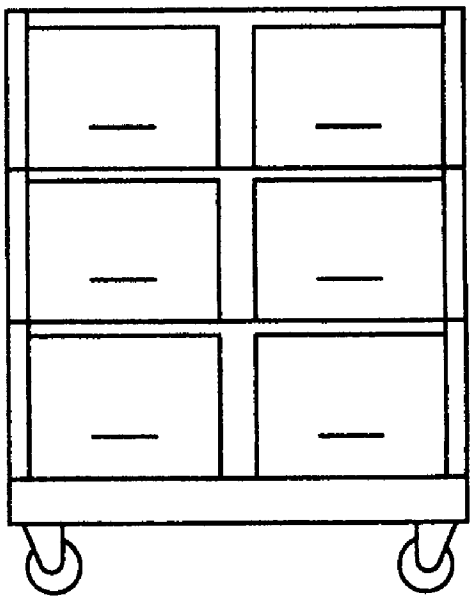
FIG. 13–19 illustrate alternative embodiments of the present invention.
Figure 14:
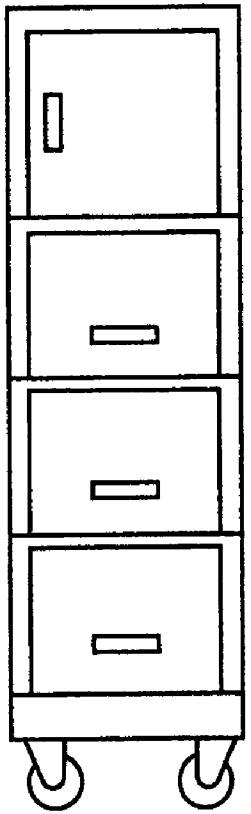
Figure 13:
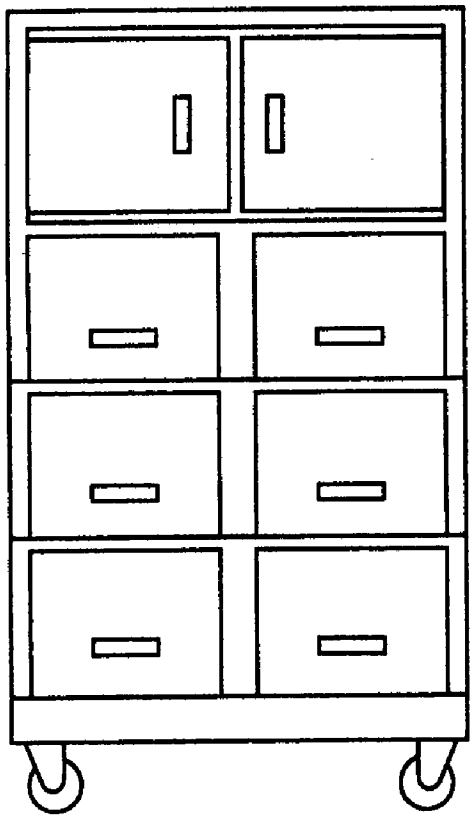
Figure 17:
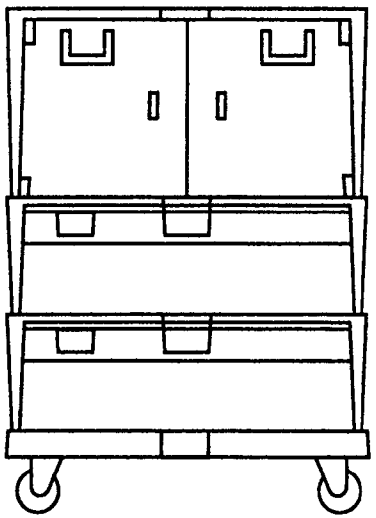
Figure 16:
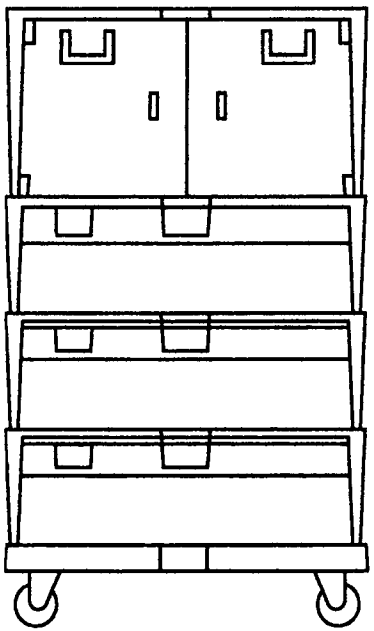

The modular construction of the embodiment illustrated in FIGS. 1–4 provides great flexibility to accommodate the needs of various offices. While FIG. 1 illustrates one configuration, many other configurations are possible within the scope of the present invention. FIG. 13 illustrates an embodiment having a wider base wherein six drawer modules are stacked three high and two wide with a double cabinet module on the top. The drawer modules shown in FIG. 13 can have dimensions similar to a conventional filing cabinet. FIG. 14 illustrates an alternative embodiment wherein a single cabinet module is arranged upon three drawer modules each comprising single drawers. FIG. 15 illustrates a six-drawer embodiment of the present invention with pairs of drawers arranged side-by-side. FIG. 16 illustrates an upper cabinet having two doors arranged over three drawers. FIG. 17 illustrates a cabinet module having two doors arranged over two drawer modules.

Figure 19:
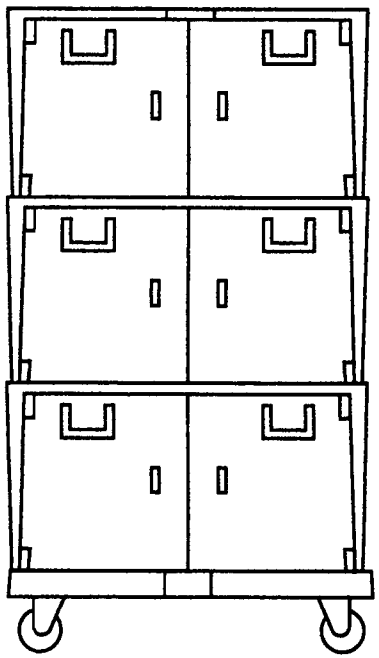
Figure 18:
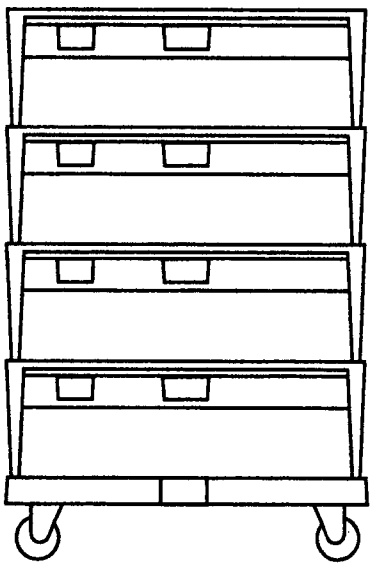

FIG. 18 illustrates a four-drawer module unit. FIG. 19 illustrates a three cabinet module wherein each cabinet module has two cabinet doors.

Figure 20:
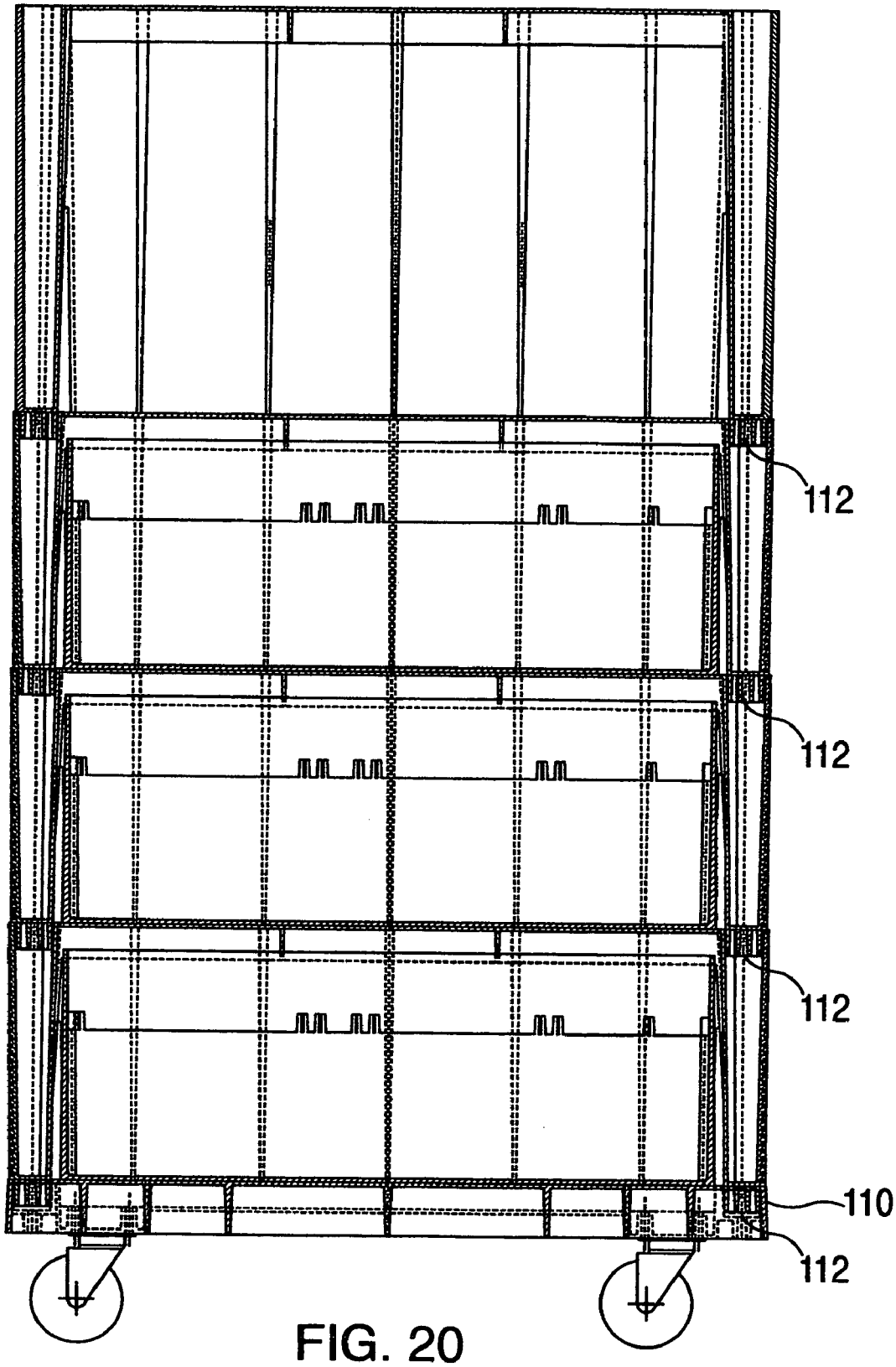
FIG. 20 is a cross-sectional view through interlocking protrusion/receptacles.

FIG. 20 is a cross-sectional view of the embodiment shown in FIG. 16 wherein the protrusions of each module are shown within the receptacles of adjacent lower modules and the protrusions of the bottom frame are shown positioned within the base 110.

In order to serve the intended purpose of moving office equipment and files, the cabinet modules and drawer modules most also have sufficient height, width and depth. For example, the interior dimensions of the cabinet modules are preferably at least 15×24×15 inches and most preferably at least 21×42×28 inches. The interior of the drawer modules are preferably at least 10×24×15 inches, and most preferably 11×36×24 inches. The footprints of the carts, excluding the casters are preferably about 15 inches wide by about 24 inches long by about 15 inches deep to about 36 inches wide to about 60 inches long and about 36 inches deep.

Figure 23:
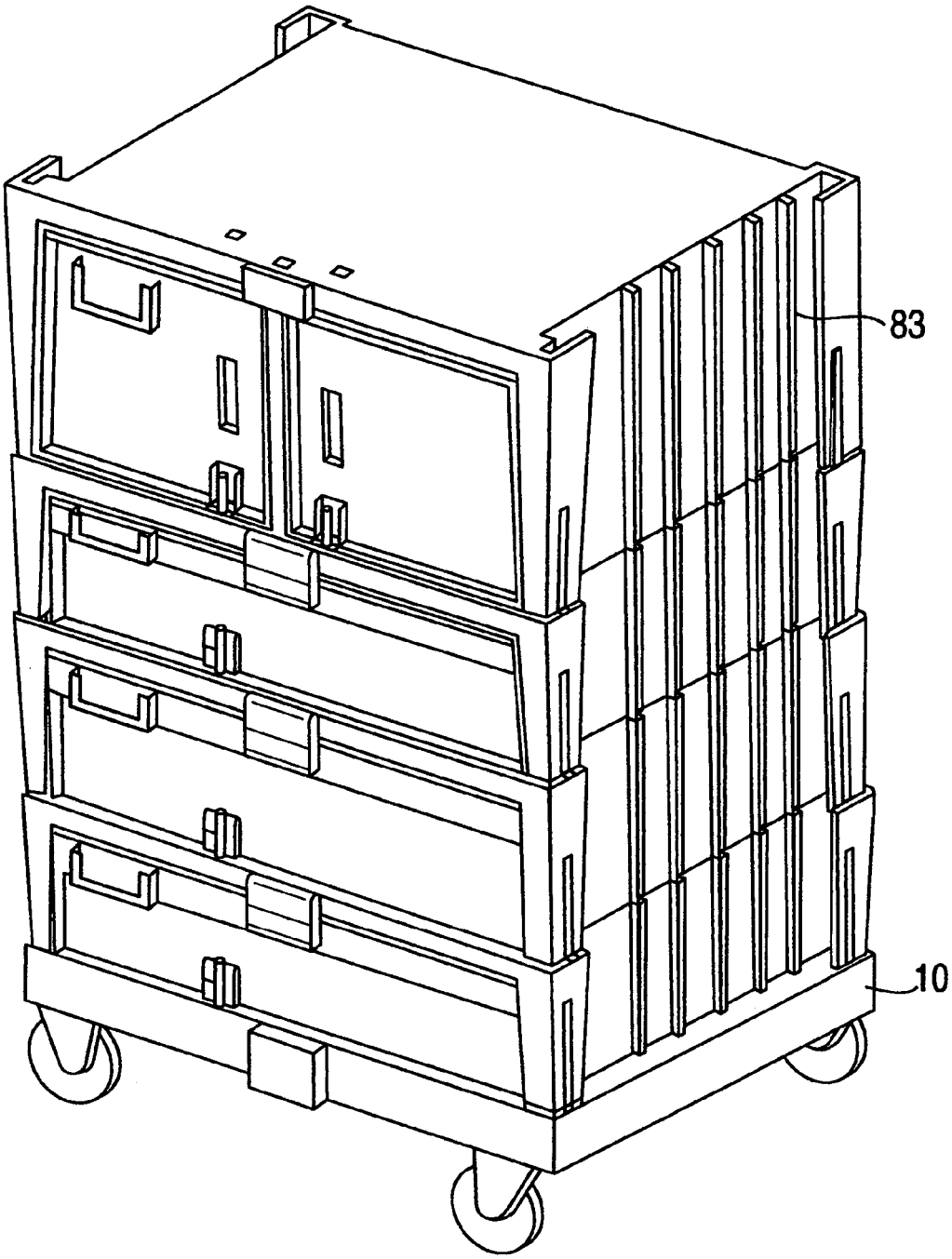
FIG. 23 is a perspective view of a preferred embodiment of the present invention.

FIGS. 1–4, 16–19 and 21–22 illustrate tapered frames and tapered support ribs of various embodiments of the present invention. The taper to the frames, as well as the taper of the support ribs facilitates the molding of the frames and especially removal of the frames from the mold. The taper of the internal support ribs 85 is best shown in FIGS. 6, 8 and 21. FIG. 23 also clearly illustrates the vertical alignment of the right side support ribs 83 and the positioning of support rib 83 as well as the side walls as they rest upon base 10.

Figure 24:
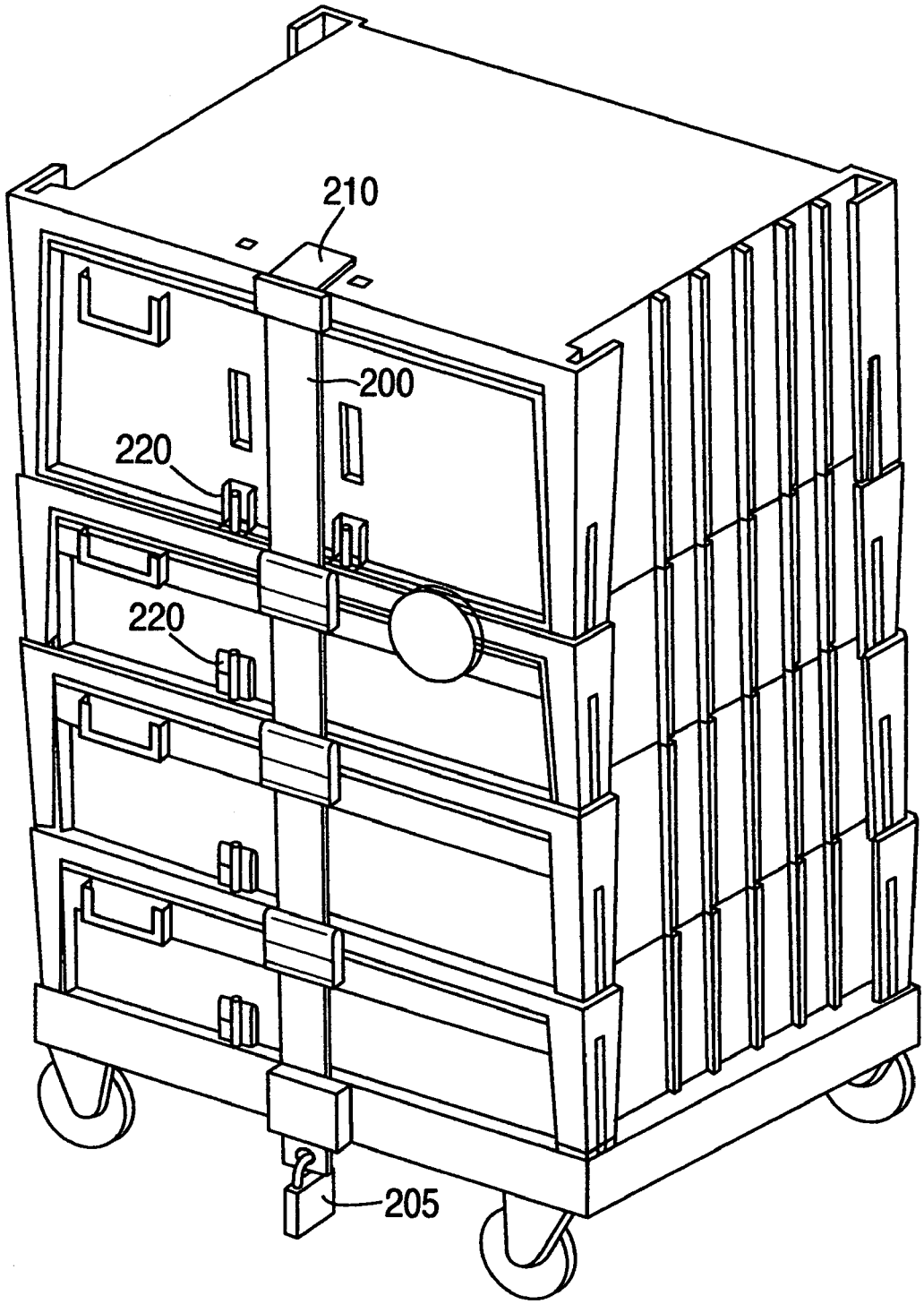
FIG. 24 is a perspective view of one preferred embodiment with a security bar and lock.

FIG. 24 illustrates the positioning of a locking bar 200 along with a lock 205. As illustrated locking bar 200 extends through the handles of the frames and has a lock 205 at one end and an angular portion 210 at the end opposite the lock in order to prevent removal of contents by unauthorized personnel. FIG. 24 also illustrates the sliding barrel locks 220 which are provided to prevent the doors and drawers from opening accidentally during moving.

Figure 25:
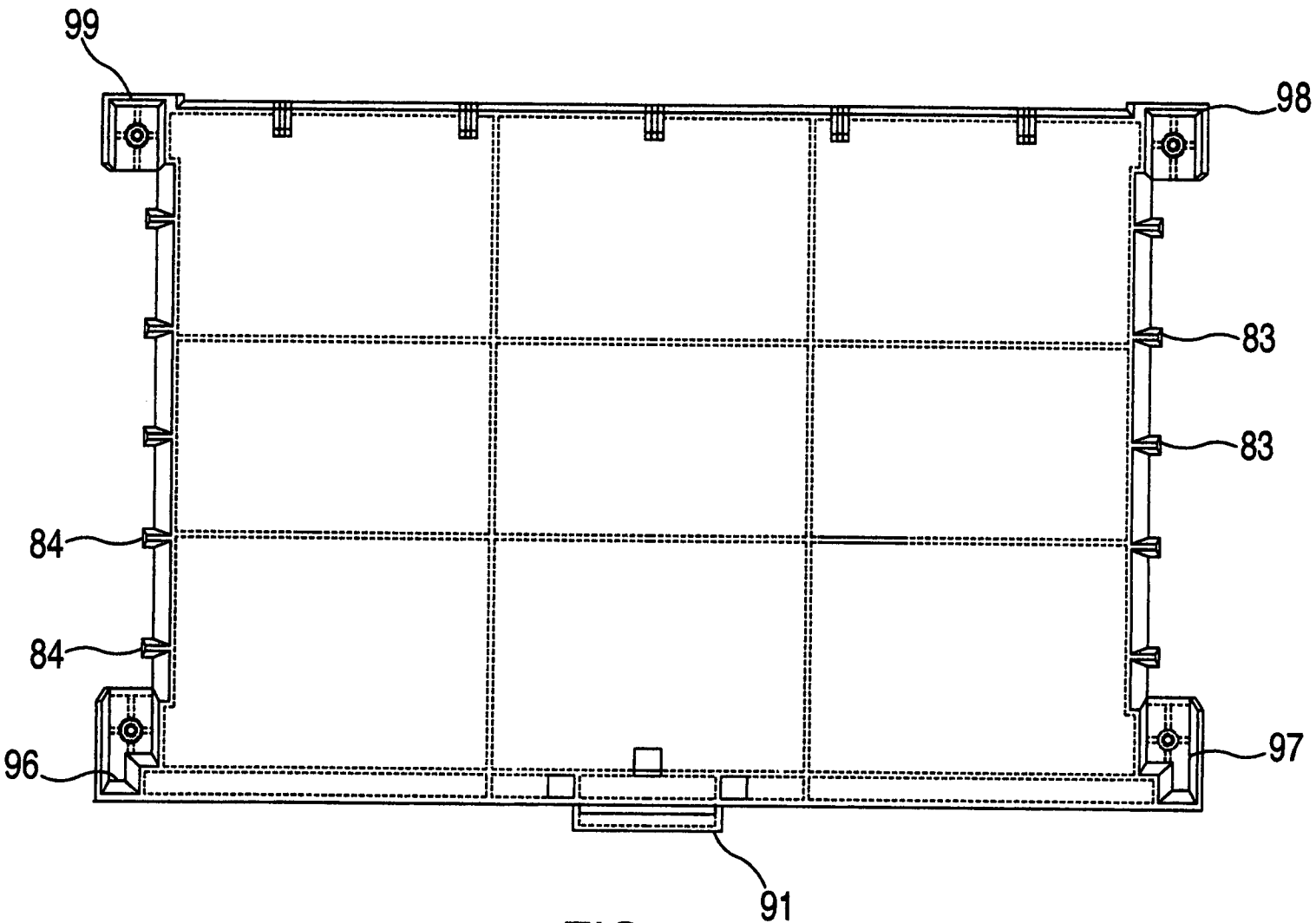
FIG. 25 is a top view of a frame.

FIG. 25 is a top view of a frame illustrating forward receptacles 96, 97 and rear receptacles 98, 99, as well as the tapering side support ribs 83 and 84. Additionally, slot receptacle 91 which receives locking bar 200 is illustrated.

Figure 27:
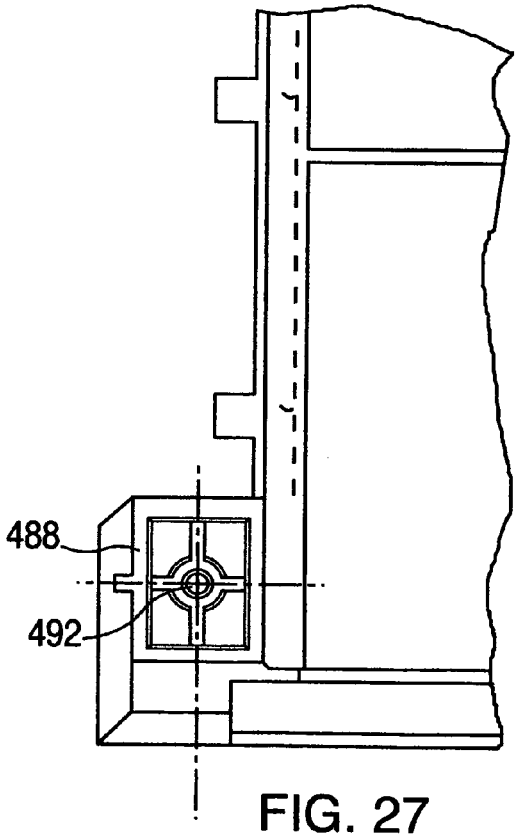
FIG. 27 is a bottom view of a portion of a frame showing an interconnecting protrusion.

FIG. 27 is a partial bottom view of a frame illustrating a protrusion 488 comprising a through hole 492 for receiving a securing member.

Figure 28:
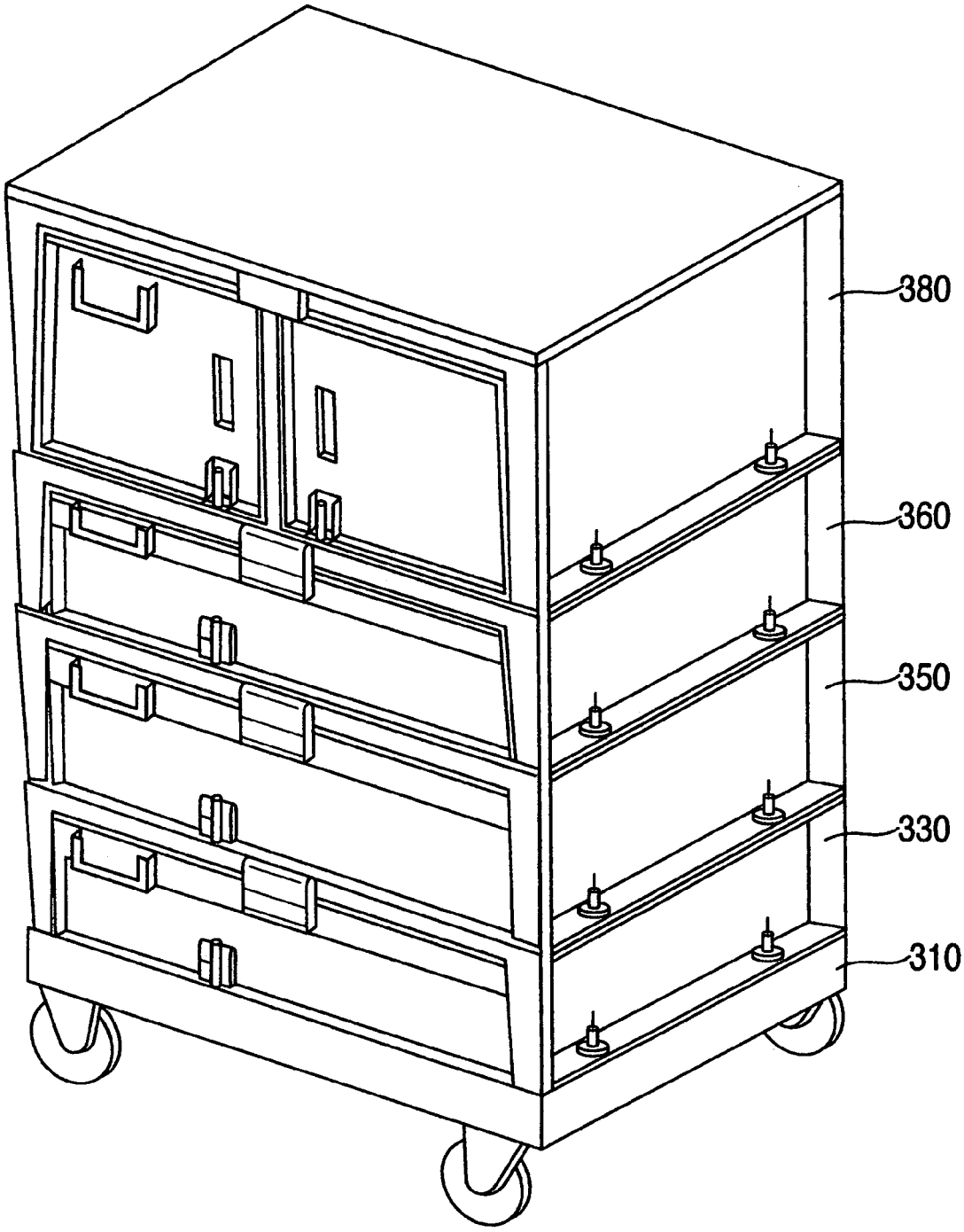
FIG. 28 illustrates an alternative modular embodiment of the present invention.

FIG. 28 illustrates an alternative modular embodiment of the present invention comprising a base 310, three drawer modules 330, 350, 360 and an upper cabinet module 380. In this illustrated embodiment, each module is provided with flanges which are connected to the vertically adjacent base and/or module with a bolt, nut and washer assembly. This configuration eliminates the need for vertical support ribs.

Figure 29:
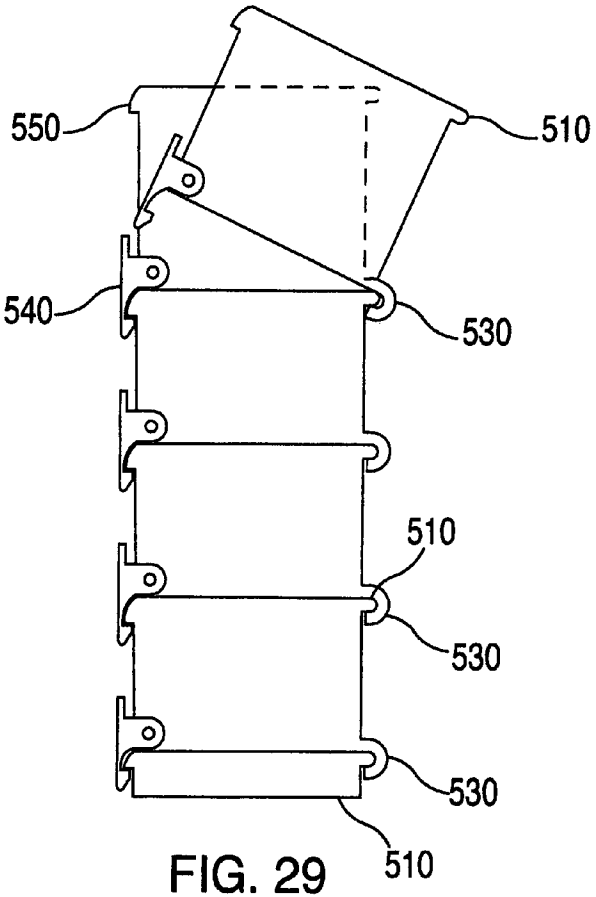
FIG. 29 illustrates a still further modular embodiment of the present invention.

FIG. 29 illustrates another modular embodiment of the present invention wherein adjacent modules are attached with a channel and snap assembly. According to this embodiment, one side of each frame and the base 510 are provided with a horizontal projection 520 and a channel 530. In the illustrated embodiments, the projection 510 is located on the top of the base and/or module while the channel 530 is located on the lower portion. The opposite side of the frame or module is provided with an upper extension 550 and a lower spring biased hook 540. In order to connect a frame to a lower, adjacent frame, the channel 530 is positioned over the horizontal projection 510 of a lower, adjacent frame and the frame is then pivoted in order to lock the spring biased hook 540 around a forward projection 550.

Figure 30:
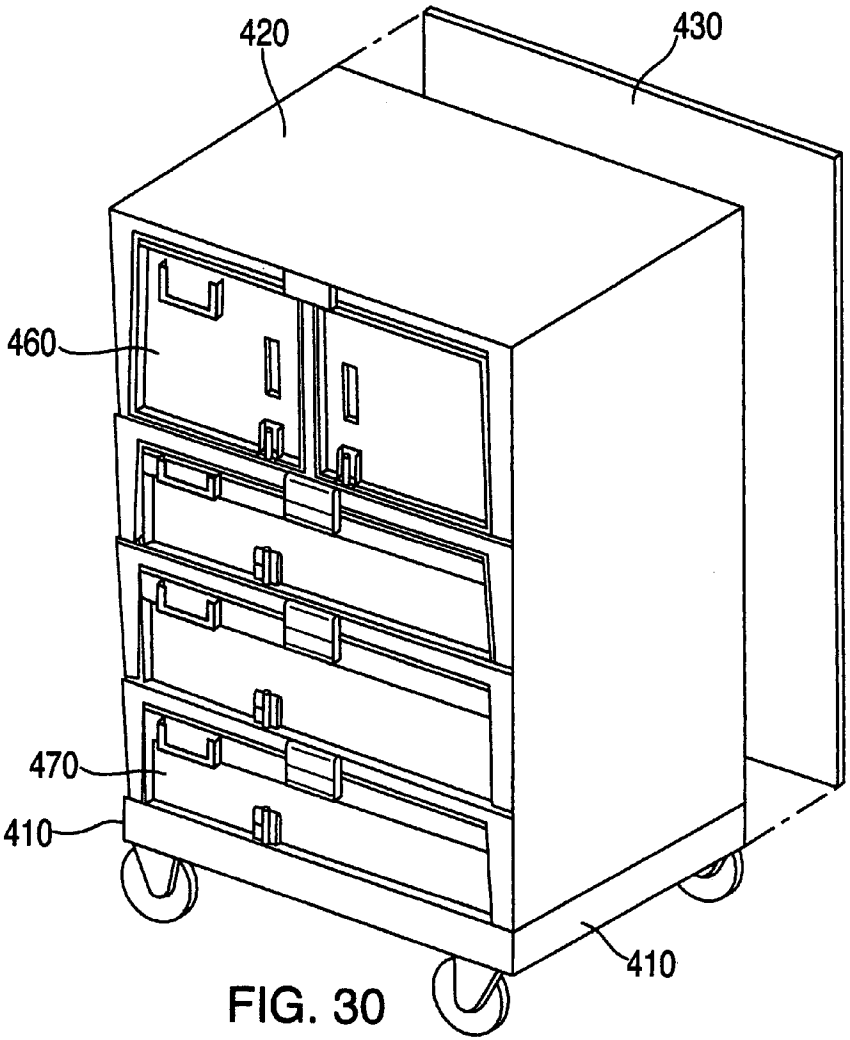
FIGS. 30 and 31 illustrate still further embodiments of the present invention.
Figure 31:
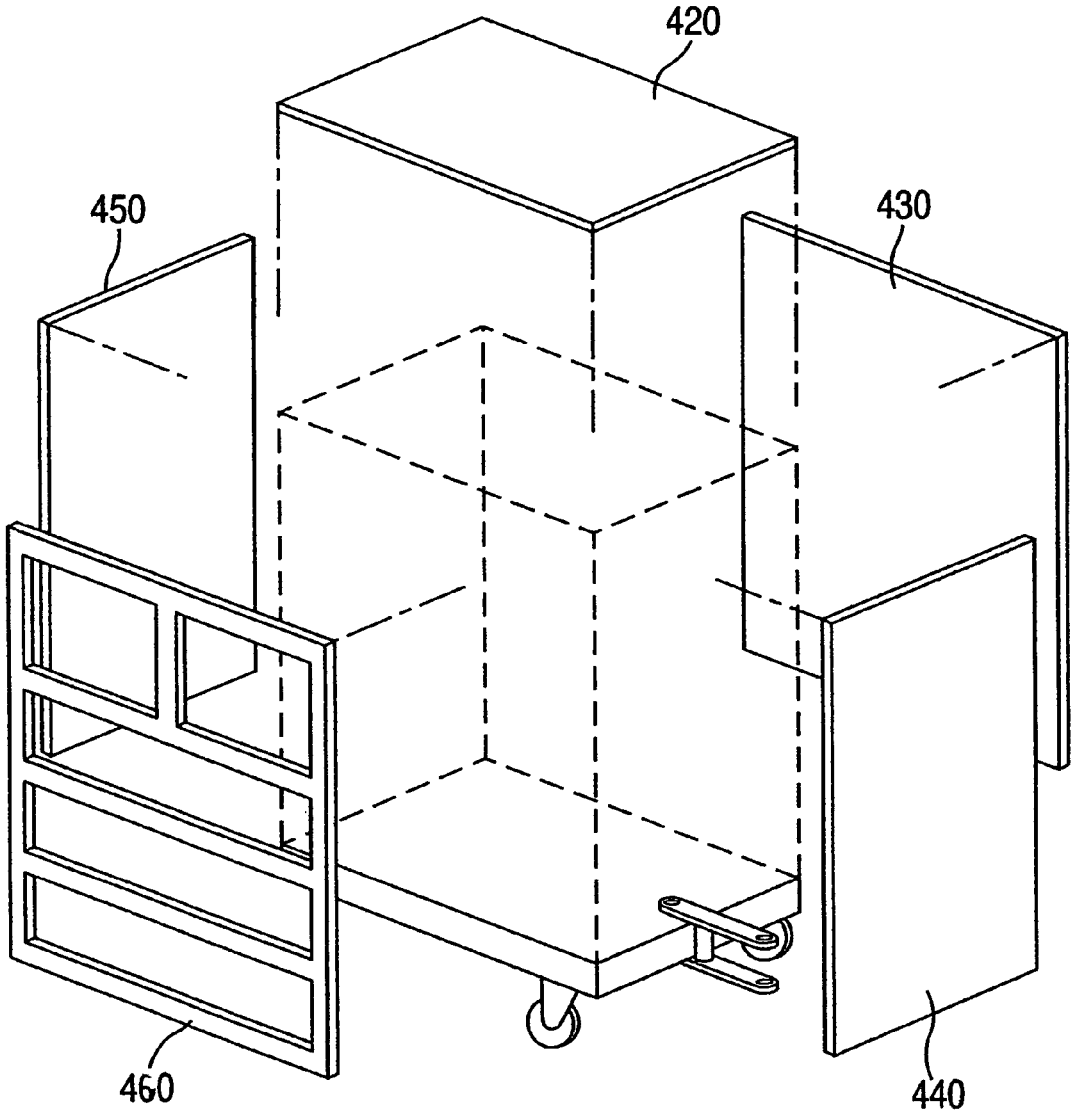

FIGS. 30 and 31 illustrate another embodiment of the present invention which is not modular but which comprises a top section 420, a rear section 430, right side element 440, left side element 450, front frame 460, drawers 470 and cabinet doors 480. As shown in FIG. 31, base 410 is advantageously provided with a hitch to permit connection of multiple carts. Although not illustrated, the drawers and cabinet doors in the embodiment shown in FIGS. 30 and 31 can be similar to those described above or of different design. The side, rear, forward and top sections can be connected in any secure manner.

Figure 34:
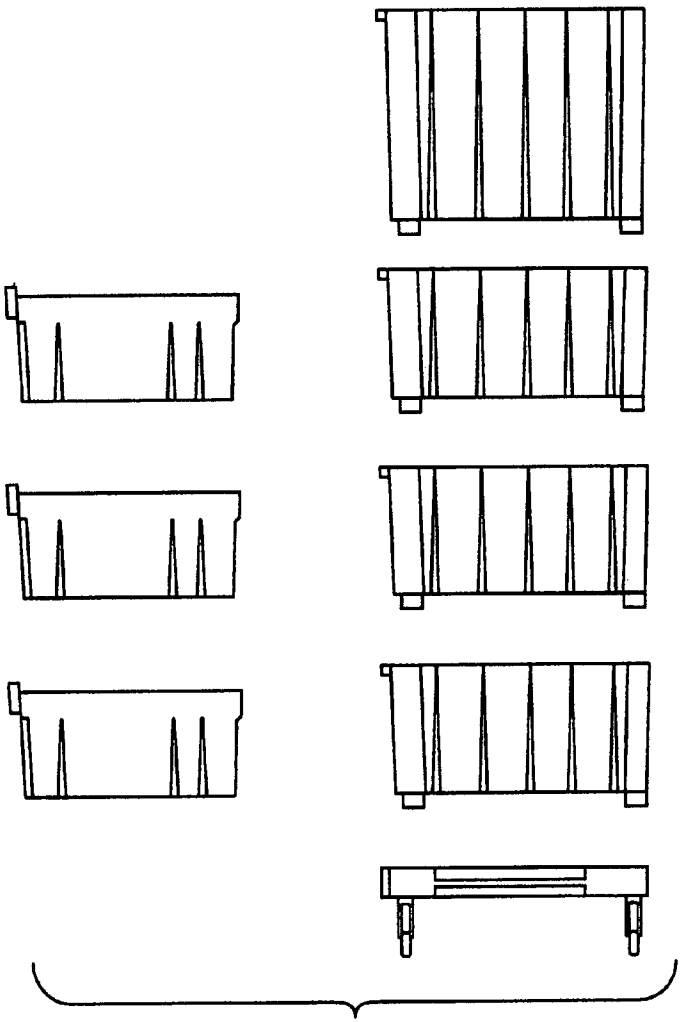
FIGS. 33 and 34 are front and side views of an alternative embodiment of the present invention.
Figure 33:
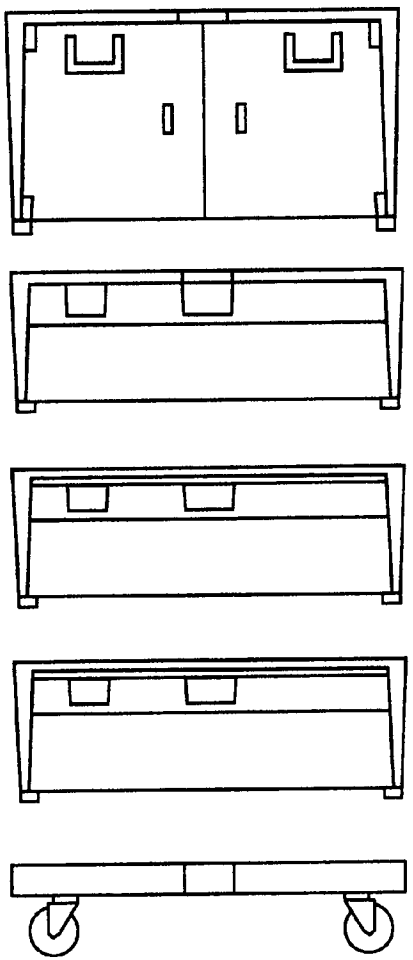

FIGS. 33 and 34 illustrate a further embodiment of the present invention wherein FIG. 33 is a front view and FIG. 34 is a side view. In this illustrated embodiment, the drawers are provided with exterior support ribs for added strength.

Figure 37:
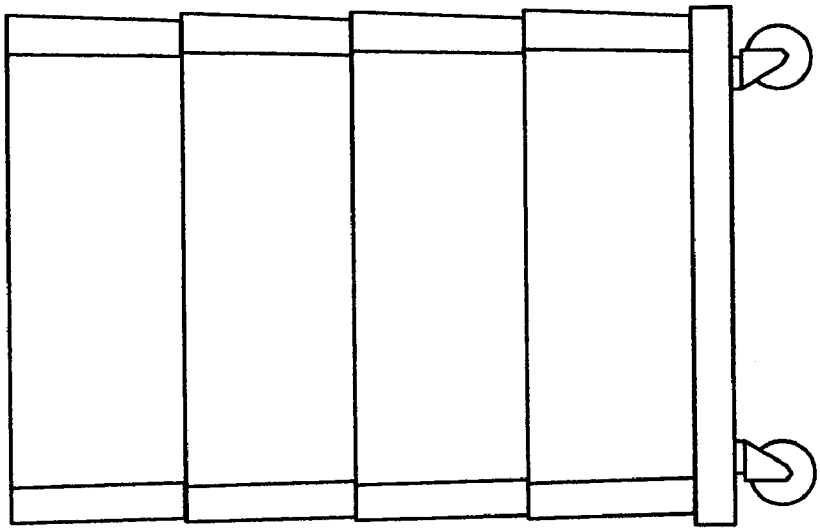
FIGS. 35–37 are front, side and rear views, respectively, of an alternative embodiment of the present invention.
Figure 36:
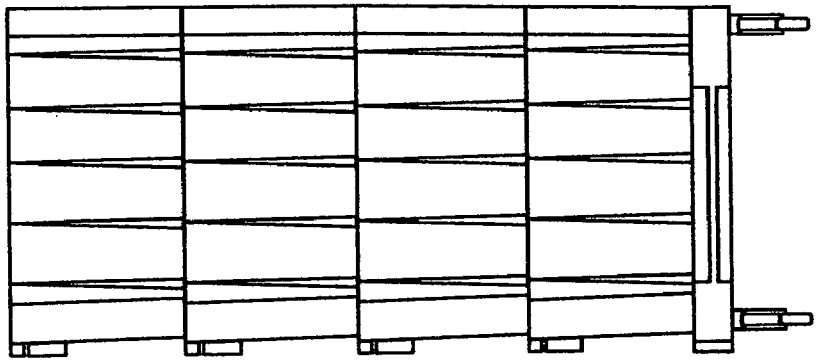
Figure 35:
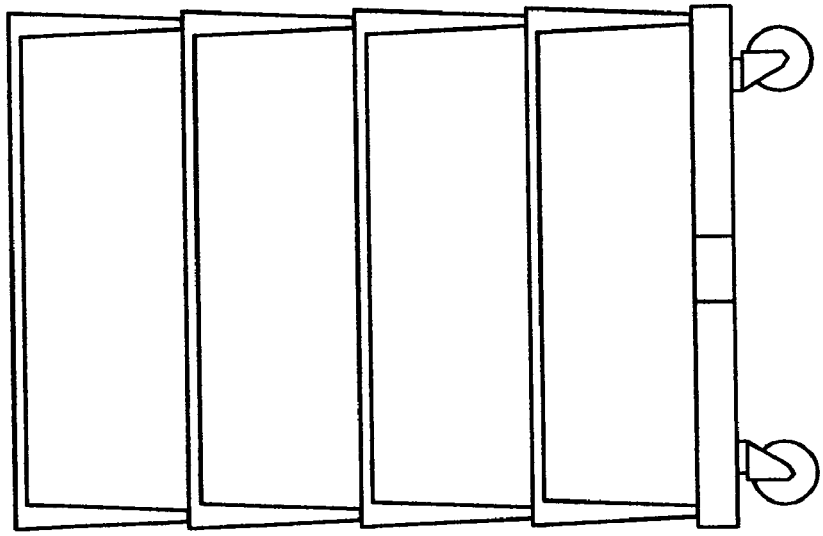
Figure 40:
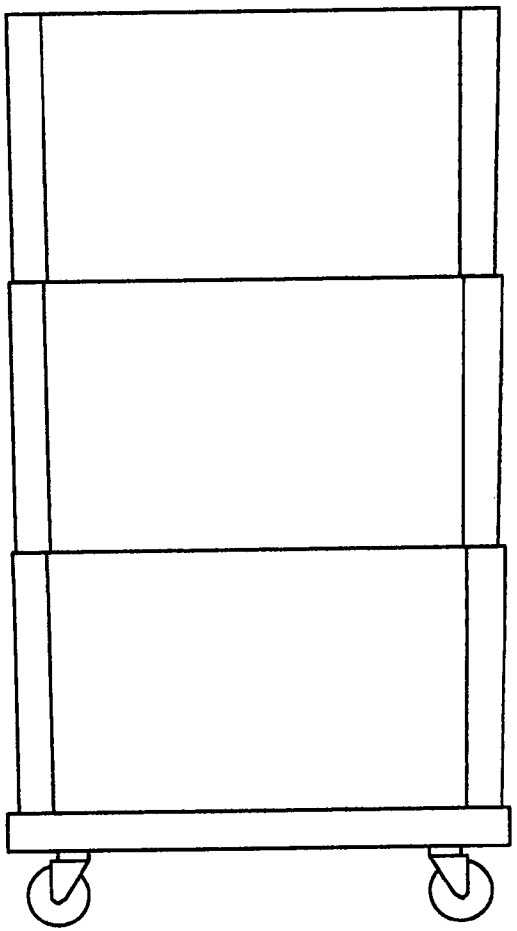
FIGS. 38–40 are front, side and rear views, respectively, of an alternative embodiment of the present invention.
Figure 39:
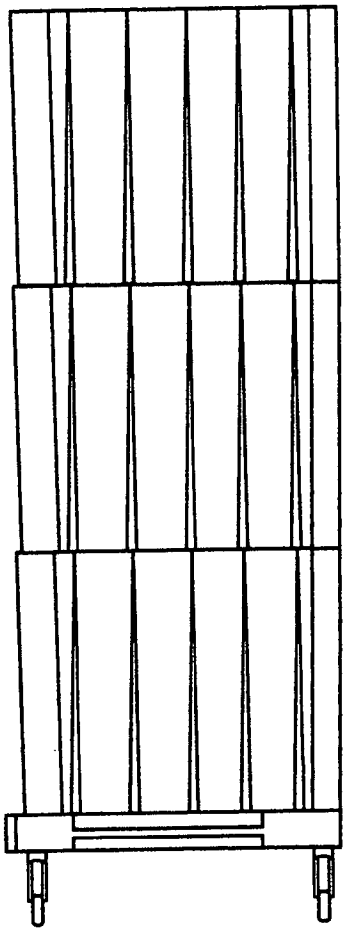
Figure 38:
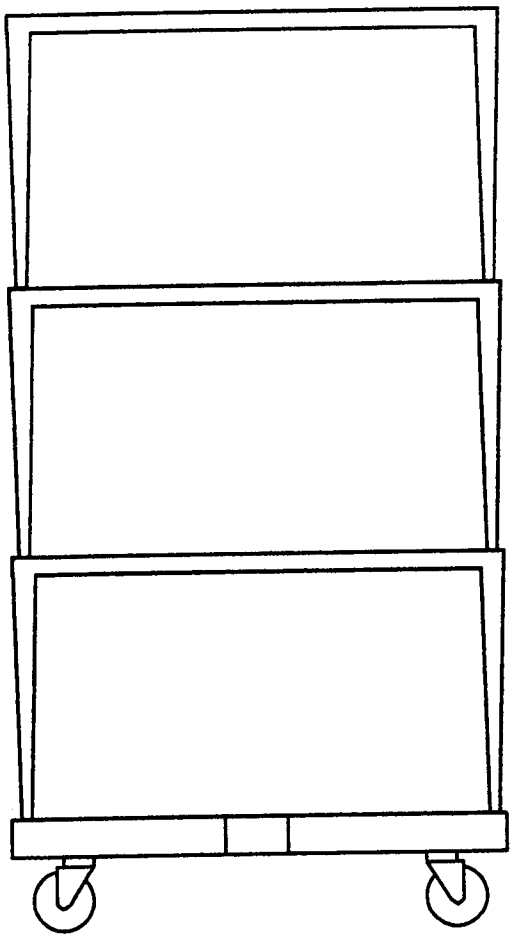

FIGS. 35–37 are front, side and rear views of an embodiment of the present invention comprising four wide drawers and having a height of about 63 inches. FIGS. 38–40 are similar view of another embodiment comprising three cabinet frames without doors. This embodiment of the present invention is particularly adapted for carting large books and is useful for transporting the contents of a library. This embodiment of the present invention can be formed with a height of about 75 inches.

The invention claimed is:

1. A moving cart assembly comprising:

a plurality of interlocking, vertically stackable storage modules forming a moving cart, each of said modules comprising:

an integrally formed frame comprising two substantially vertical sides, a back section, a horizontal support, and an opening on a front side there of, said opening extending substantially vertically for substantially the height of said module, said frame comprising four reinforced corners, said corners disposed on the exterior of said modules and each comprising an opening at one end and a projection at the opposite, vertical end for supporting and interlocking vertically adjacent modules;

means for enclosing the interior of each of said modules to form a plurality of enclosures, and said enclosing means selectively closing said front side opening, moveable supports to facilitate movement of said cart assembly, each of said moveable supports having a load bearing capacity of at least about 75 pounds.

2. A moving cart assembly according to claim 1 wherein at least one of said enclosing means comprises at least one door.

3. A moving cart assembly according to claim 2 wherein at least one of said enclosing means comprises a pair of doors.

4. A moving cart assembly according to claim 3 wherein said doors are supported by hinges located inside the enclosure.

5. A moving cart assembly according to claim 3 wherein said doors are supported by hinges located outside the enclosure.

6. A moving cart assembly according to claim 2 wherein said door comprises an identification slot.

7. A moving cart assembly according to claim 1 wherein at least one of said enclosing means comprises a drawer.

8. A moving cart assembly according to claim 7 wherein said drawer comprises rails spaced to support hanging files.

9. A moving cart assembly according to claim 8 comprising rails spaced to support at least two different sizes of hanging files.

10. A moving cart assembly according to claim 1 comprising a plurality of connectable carts and means for selectively connecting said carts.

11. A moving cart assembly according to claim 10 wherein said connecting means comprises at least one retractable hitch.

12. A moving cart assembly according to claim 10 wherein said connecting means comprises a retractable hitch on each cart.

13. A moving cart assembly according to claim 1 wherein a plurality of said modules, comprise vertically-aligned support ribs.

14. A moving cart assembly according to claim 13 wherein at least one of said support ribs is located on said vertical sides of said modules.

15. A moving cart assembly according to claim 14 wherein at least some of said support ribs are located on external vertical sides of said modules.

16. A moving cart assembly according to claim 13 wherein at least one of said support ribs is located on at least one external, vertical surface of said frame.

17. A moving cart assembly according to claim 16 wherein at least one of said support ribs is located on at least one internal, vertical surface of said frame.

18. A moving cart assembly according to claim 17 wherein said support ribs are vertically tapered.

19. A moving cart assembly according to claim 1 comprising support ribs located on at least one internal, vertical surface of said frame.

20. A moving cart assembly according to claim 13 wherein said support ribs are vertically tapered.

21. A moving cart assembly according to claim 1 wherein a plurality of said modules comprise a plurality of receptacles and a corresponding plurality of protrusions wherein adjacent modules are vertically interconnected with a protrusion from one module received in a corresponding receptacle of an adjacent module.

22. A moving cart assembly according to claim 21 comprising means for securing a plurality of said modules together.

23. A moving cart assembly according to claim 22 wherein said securing means comprises an elongated member which passes vertically through portions of a plurality of modules of a cart.

24. A moving cart assembly according to claim 22 wherein said securing means comprises an elongated member extending vertically through portions of all modules of a cart.

25. A moving cart assembly according to claim 22 wherein said securing means comprises at least one tie-rod.

26. A moving cart assembly according to claim 22 wherein said securing means comprises a plurality of tie-rods.

27. A moving cart assembly according to claim 22 wherein said securing means comprises an elongated member which passes vertically through said protrusions of a plurality of modules of a cart.

28. A moving cart assembly according to claim 1 comprising means for securing a plurality of said modules together.

29. A moving cart assembly according to claim 1 comprising means for selectively locking said enclosing means.

30. A moving cart assembly according to claim 29 wherein said frames comprise projecting slots and said locking means comprises a bar which is selectively positionable in said slots.

31. A moving cart assembly according to claim 1 wherein said frames are vertically tapered.

32. A moving cart assembly according to claim 1 comprising a base.

33. A moving cart assembly according to claim 32 comprising at least one weight to enhance stability.

34. A moving cart assembly according to claim 32 wherein said base comprises means for connecting a cart to another cart.

35. A moving cart assembly according to claim 34 wherein said connecting means comprises at least one retractable hitch.

36. A moving cart assembly according to claim 35 wherein said connecting means comprises a plurality of retractable hitches.

37. A moving cart assembly according to claim 1 wherein said frame is an integrally molded element.

38. A moving cart assembly according to claim 1 wherein said frame comprises a material selected from the group consisting of polyethylene and polypropylene.

39. A moving cart assembly according to claim 1 wherein said frame comprises high density polyethylene structural foam.

40. A moving cart assembly according to claim 1 wherein said frame comprises polypropylene structural foam.

41. A moving cart assembly according to claim 1 wherein said frame comprises a structural foam plastic.

42. A moving cart assembly according to claim 1 wherein at least one of said modules is a cabinet module having an inside height of at least 20 inches.

43. A moving cart assembly according to claim 42 wherein a plurality of said modules are cabinet modules having an inside height of at least 20 inches.

44. A moving cart assembly according to claim 42 wherein at least one of said modules is a drawer module having an inside height of at least 11 inches.

45. A moving cart assembly according to claim 44 wherein a plurality of said modules are drawer modules having an inside height of at least 11 inches.

46. A moving cart assembly according to claim 42 comprising a plurality of cabinet modules each having an inside height of at least 20 inches and a plurality of drawer modules having an inside height of at least 11 inches.

47. A moving cart assembly according to claim 1 comprising a plurality of drawers disposed side-by-side on a cart.

48. A moving cart assembly according to claim 47 comprising a plurality of cabinets disposed side-by-side on a cart.

49. A moving cart assembly according to claim 1 wherein said frames comprise flanges and means for connecting flanges of adjacent frames.

50. A moving cart assembly according to claim 49 wherein said connecting means comprises nuts and bolts.

51. A moving cart assembly according to claim 1 further comprising means for locking said enclosing means.

52. A moving cart assembly comprising:

a base;

a plurality of movable supports, capable of supporting at least about 75 pounds each, attached to said base;

a plurality of interlocking, vertically stackable storage modules forming a moving cart, each of said modules comprising:

an integrally formed frame comprising two substantially vertical sides, a back section, a horizontal support, and an opening on a front side there of, said opening extending substantially vertically for substantially the height of said module, means for enclosing the interior of each of said modules to form a plurality of enclosures, and said enclosing means selectively closing said front side opening.

53. A moving cart assembly according to claim 52 wherein at least one of said compartments comprises at least one door.

54. A moving cart assembly according to claim 53 wherein at least one of said compartments comprises a pair of doors.

55. A moving cart assembly according to claim 53 wherein said door is supported by hinges located inside the enclosure.

56. A moving cart assembly according to claim 53 wherein said door comprises an identification slot.

57. A moving cart assembly according to claim 52 wherein at least one of said enclosing means comprises a drawer.

58. A moving cart assembly according to claim 57 wherein said drawer comprises rails spaced to support hanging files.

59. A moving cart assembly according to claim 58 comprising rails spaced to support at least two different sizes of hanging files.

60. A moving cart assembly according to claim 52 comprising a plurality of connectable carts and means for selectively connecting said carts.

61. A moving cart assembly according to claim 60 wherein said connecting means comprises at least one retractable hitch.

62. A moving cart assembly according to claim 60 wherein said connecting means comprises a retractable hitch on each cart.

63. A moving cart assembly according to claim 61 wherein said cart assembly comprises a plurality of modules.

64. A moving cart assembly according to claim 63 wherein a plurality of said modules comprise vertically-aligned support ribs and at least one of said support ribs is located on vertical sides of said modules.

65. A moving cart assembly according to claim 64 wherein at least some of said support ribs are located on external vertical sides of said modules.

66. A moving cart assembly according to claim 64 comprising support ribs located on at least one external, vertical surface of said frame.

67. A moving cart assembly according to claim 66 comprising support ribs located on at least one internal, vertical surface of said frame.

68. A moving cart assembly according to claim 67 wherein said support ribs are vertically tapered.

69. A moving cart assembly according to claim 63 wherein a plurality of said modules comprise a plurality of receptacles and a corresponding plurality of protrusions wherein adjacent modules are vertically interconnected with a protrusion from one module received in a corresponding receptacle of an adjacent module.

70. A moving cart assembly according to claim 63 comprising means for securing a plurality of said modules together.

71. A moving cart assembly according to claim 70 wherein said securing means comprises an elongated member which passes vertically through portions of a plurality of modules of a cart.

72. A moving cart assembly according to claim 70 wherein said securing means comprises an elongated member extending vertically through portions of all modules of a cart.

73. A moving cart assembly according to claim 70 wherein said securing means comprises at least one tie-rod.

74. A moving cart assembly according to claim 1 comprising means for selectively locking said enclosures.

75. A moving cart assembly according to claim 52 wherein said base comprises means for connecting a cart to another cart.

76. A moving cart assembly according to claim 75 wherein said connecting means comprises at least one retractable hitch.

77. A moving cart assembly according to claim 75 wherein said connecting means comprises a plurality of retractable hitches.

78. A moving cart assembly according to claim 52 wherein each compartment is an integrally molded element.

79. A moving cart assembly according to claim 52 wherein said assembly comprises a material selected from the group consisting of polyethylene and polypropylene.

80. A moving cart assembly according to claim 52 wherein said assembly comprises high density polyethylene structural foam.

81. A moving cart assembly according to claim 52 wherein said assembly comprises polypropylene structural foam.

82. A moving cart assembly according to claim 52 wherein said frame comprises a structural foam plastic.

83. A moving cart assembly comprising:

a plurality of interlocking, vertically stackable storage modules forming a moving cart, each of said modules comprising:

an integrally formed frame comprising two substantially vertical sides, a back section, a horizontal support, and an opening on a front side there of, said opening extending substantially vertically for substantially the height of said module, means for enclosing the interior of each of said modules to form a plurality of enclosures, and said enclosing means selectively closing said front side opening, moveable supports to facilitate movement of said cart assembly, each of said moveable supports having a load bearing capacity of at least about 75 pounds.

* * * * *